US006317713B1

(12) United States Patent
Tenpaku

(10) Patent No.: US 6,317,713 B1
(45) Date of Patent: Nov. 13, 2001

(54) SPEECH SYNTHESIS BASED ON CRICOTHYROID AND CRICOID MODELING

(75) Inventor: Seiichi Tenpaku, Minoh (JP)

(73) Assignee: Arcadia, Inc., Osaka (JP)

( * ) Notice: Subject to any disclaimer, the term of this patent is extended or adjusted under 35 U.S.C. 154(b) by 0 days.

(21) Appl. No.: 09/155,156

(22) PCT Filed: Mar. 14, 1997

(86) PCT No.: PCT/JP97/00825

§ 371 Date: Jan. 6, 1999

§ 102(e) Date: Jan. 6, 1999

(87) PCT Pub. No.: WO97/36286

PCT Pub. Date: Oct. 2, 1997

(30) Foreign Application Priority Data

Mar. 25, 1996 (JP) ..... 8-068420

(51) Int. Cl.[7] ..... G10L 13/02; G10L 13/08

(52) U.S. Cl. ..... 704/261; 704/268; 704/266; 704/260

(58) Field of Search ..... 704/231, 205, 704/206, 258, 260, 261, 266, 268; 607/48, 72, 134; 128/902; 600/380

(56) References Cited

U.S. PATENT DOCUMENTS

| | | | | |
|---|---|---|---|---|
| 3,908,085 | * | 9/1975 | Gagnon | 704/261 |
| 4,624,012 | * | 11/1986 | Lin et al. | 704/261 |
| 5,016,647 | * | 5/1991 | Sanders | 607/72 |
| 5,111,814 | * | 5/1992 | Goldfarb | 607/48 |
| 5,134,657 | * | 7/1992 | Winholtz | 704/231 |

* cited by examiner

*Primary Examiner*—David D. Knepper
(74) *Attorney, Agent, or Firm*—Michael D. Bednarek; Shaw Pittman LLP

(57) ABSTRACT

Sound generating parameters are used for outputting fundamental frequency and a command regarding prosody, and a sound source generator. The sound generation device further includes use of an accent command and a descent command for calculating fundamental frequency and incorporates a rhythm command, which is representable by a sine wave. The device also uses character string analysis for analyzing a character string and generating a command concerning phoneme and prosody, a calculating element for outputting fundamental frequency as sound generation parameters, which depends on prosody, a sound source generator, and an articulator that depends on a phoneme command.

13 Claims, 31 Drawing Sheets

LARYNX MODEL USING SPRINGS

FIG.4A

WORD DICTIONARY

| WORD | PART OF SPEECH | READING | ------ | SYLLABLE | ACCENT VALUE | DESCENT VALUE |
|---|---|---|---|---|---|---|
| 桜 | NOUN | sakura | ------ | sa | 1 | 0 |
| | | | | ku | 5 | 0 |
| | | | | ra | 0 | 2 |
| さく | VERB | saku | ------ | sa | 5 | 0 |
| | | | | ku | 0 | 0 |
| ⋮ | ⋮ | ⋮ | | ⋮ | ⋮ | ⋮ |
| が | POSTPOSITIONAL PRATICLE | ga | ------ | ga | 2 | 0 |
| ⋮ | ⋮ | ⋮ | | ⋮ | ⋮ | ⋮ |

FIG.4B

DICTIONARY 5 OF SYLLABLE DURATION

| SYLLABLE | DURATION |
|---|---|
| a | 110 |
| i | 114 |
| u | 90 |
| ⋮ | ⋮ |
| ko | 188 |
| ⋮ | ⋮ |

FIG.4c

| SYLLABLE | CHAIN OF SYLLABLE SEQUENCE | TIME [ms] | SYLLABLE DURATION [ms] | ACCENT VALUE | DESCENT VALUE |
|---|---|---|---|---|---|
| KO | KoN | 0 | 188 | 0 | 0 |
| N | Nni | 188 | 92 | 5 | 0 |
| ni | nich | 280 | 212 | 5 | 0 |
| chi | chiw | 492 | 178 | 0 | 2 |
| Wa | wa | 670 | 166 | 7 | 0 |

FIG.4D

DICTIONARY 6 VOICED/UNVOICED SOUNDS OF CONSONANTS/VOWELS

| PHONEME | INDEX |
|---|---|
| a | V |
| I | V |
| ⋮ | ⋮ |
| k | CU |
| ⋮ | ⋮ |
| b | CV |
| ⋮ | ⋮ |

DICTIONARY 16 OF AMPLITUDE OF SOUND SOURCE

| SYLLABLE | AMPLITUDE |
|---|---|
| a |   |
| ⋮ | ⋮ |
| ko |   |
| ⋮ | ⋮ |

Av VOICED SOUND SOURCE AMPLITUDE

Af UNVOICED SOUND SOURCE AMPLITUDE

FIG.4F

PHONEME DICTIONARY 14

| SYLLABLE | TIME | VOCAL TRACT TRANSMISSION CHARACTERISTIC |
|---|---|---|
| a | 0 ~ 2 ms | A, f |
| | ⋮ | ⋮ |
| | 108 ~ 110 ms | A, f |
| ⋮ | ⋮ | ⋮ |
| ko | 0 ~ 2 ms | A, f |
| | ⋮ | ⋮ |
| | 186 ~ 188 ms | A, f |
| ⋮ | ⋮ | ⋮ |

MODEL OF LARYNX

MECHANISM OF RAISING FUNDAMENTAL FREQ.

MECHANISM OF LOWERING FUNDAMENTAL FREQ.

LARYNX MODEL USING SPRINGS

RECTANGULAR PATTERNS OF ACCENTS

τ1−τ2

STRAIGHT LINE INDICATING THE INCLINATION OF FUNDAMENTAL FREQ.

INPUT PARAMETERS INTO THE FUNDAMENTAL FREQUENCY GENERATION MODEL

CULCULATED RESULTS AND THE SAMPLING DATE

SPEECH UTTERANCE BY MALE, APPROXIMATION ERROR OF 3.8%

SPEECH UTTERANCE BY MALE, APPROXIMATION ERROR OF 8.9%

SPEECH UTTERANCE BY FEMALE, APPROXIMATION ERROR OF 1.9%

SPEECH UTTERANCE BY FEMALE, APPROXIMATION ERROR OF 6.8%

PARAMETERS INDICATING SPEECH UTTERANCE TENDENCY (A LEAST SQUARES METHOD) AND Fo PATTERN

PARAMETERS INDICATING SPEECH UTTERANCE TENDENCY (SINE WAVE) AND Fo PATTERN

SPEECH SYNTHESIS BASED ON CRICOTHYROID AND CRICOID MODELING

FIELD OF THE INVENTION

This invention relates to speech synthesis and speech analysis and more particularly to a sound source generator, speech synthesizer, and speech synthesizing system and method having improved versatility and precision of sound source generation.

BACKGROUND

The production of speech consists of a combination of three elements: generation of a sound source, articulation by the vocal tract, and radiation from the lips and nostrils. By simplifying these elements and separating sound source and articulation, a generation model of speech waveform can be represented.

Generally, speech has two characteristics. One, relating to articulation, is the phonemic characteristic, which is mainly shown in the change patterns of the spectrum envelope of the sound. The other, relating to the sound source, is the prosody characteristic, which is mainly shown in the fundamental frequency patterns of the sound.

In speech synthesis based on text data, the required information for synthesizing the phonemic characteristic can be obtained from the text data by using morphological analysis. In contrast, the waveform of fundamental frequency required for synthesizing the prosody characteristic is not shown in the text data. Therefore, this waveform must be obtained according to the accent pattern of a word, the syntax of a sentence, the discourse structure of sentences, and so on.

The Fujisaki model is one of the well-known models for generation of fundamental frequency. A focus of this model is that the contour of fundamental frequency will remain nearly constant, regardless of the overall fundamental frequency, when the pattern of time curves of fundamental frequency is expressed with a logarithm. Further, the model assumes that the fundamental frequency pattern actually observed is represented by the sum of the phrase component, which moderately falls from the beginning through the end of the phrase, and the accent component, which indicates the accent on each word. From this assumption, both components are approximated by a second-order critical damping linear system response against the impulse phrase command, and a step accent command.

As described above, based on the word's accent pattern, the syntax of a sentence, and the discourse structure of sentences, the phrase command and the accent command are calculated, for which fundamental frequency can then be determined.

However, the above model for the generation of fundamental frequency has the problem that the fundamental frequency cannot be controlled more precisely, because only rise in fundamental frequency is taken into consideration. In other words, there is a limitation in adding a various expression into synthesized speech sound. Another problem is that the phrase command and the accent command can uncertainly be obtained when analyzing the observed fundamental frequency pattern.

Another problem is that a time lag occurs between the timing of designating the phrase command and the timing when the phrase component actually appears because the response of a second-order critical damping linear system against the impulsive phrase command is regarded as a phrase component.

SUMMARY OF THE INVENTION

An object of the present invention is to provide speech synthesis and sound source generation capable of solving the problems of the prior art and capable of adding various expressions, and further to provide speech analysis capable of analyzing fundamental frequency precisely.

The sound source generation device is characterized in that the device comprises: calculating component for sound source generating parameters for outputting fundamental frequency at least as sound source generating parameters, upon receiving the command concerning prosody and according to the said command, and sound source generating component for generating sound source upon receiving sound source generating parameters from calculating component for sound source generating parameters and according to the said sound source generating parameters, wherein not only the accent command but also the descent command are given for calculating fundamental frequency, and calculating component for sound source generating parameters calculates sound source generating parameters according to the accent command and the descent command.

The sound source generation device is further characterized in that the rhythm command is further given for calculating fundamental frequency and calculating component for sound source generating parameters calculates sound source generating parameters according to the accent command, the descent command, and the rhythm command.

The sound source generation device is further characterized in that the rhythm command is represented with a sine wave.

The sound source generation device is further characterized by controlling the characteristic of the generated sound source by means of controlling the amplitude and cycle of a sine wave.

The speech synthesis device is further characterized in that the device comprises: character string analyzing component for analyzing a given character string and generating the command concerning phoneme and the command concerning prosody, calculating component for sound source generating parameters for outputting fundamental frequency as sound source generation parameters at least, upon receiving the command concerning prosody generated by character string analyzing component and according to the said command, sound source generating component for generating sound source, upon receiving sound source generating parameters from calculating component for sound source generating parameters and according to the said sound source generation parameters, and articulation component for articulating sound source from sound source generating component according to the command concerning phoneme received from character string analyzing component, wherein character string analyzing component described above generates not only the accent command but also the descent command as the command concerning prosody, and calculating component for sound source generating parameters described above calculates fundamental frequency according to the accent command and the descent command.

The speech synthesis device is further characterized in that character string analyzing component further generates the rhythm command as the command concerning prosody and calculating component for sound source generating parameters calculates fundamental frequency according to the accent command, the descent command and the rhythm command.

The speech synthesis device is further characterized in that calculating component for sound source generating parameters generates the rhythm command as a sine wave.

The speech synthesis device is further characterized in that calculating component for sound source generating parameters controls the characteristic of synthesized speech sound generated, by means of controlling the amplitude and cycle of the said sine wave.

The speech processing method is further characterized by adopting not only the accent command but also the descent command as elements for controlling fundamental frequency in any speech processing method using fundamental frequency as parameters at least. The term "speech processing" here refers to operations in any way to process speech, characteristic concerning speech sound and parameters, including speech synthesis, sound source generation, speech analysis, and fundamental frequency generation therefor.

The speech processing method is further characterized by further adopting the rhythm command as elements for controlling fundamental frequency.

The speech analyzing method is further characterized by carrying out analysis using not only the accent command but also the descent command as elements for analyzing fundamental frequency.

The speech analyzing method is further characterized by further adopting the rhythm command as elements for analyzing fundamental frequency.

The storing medium is a computer-readable storing medium for storing programs which are executable by using a computer, for executing any device or method of the present invention by using a computer. The phrase "programs executable by using a computer" here, refers to programs stored on the said storing medium are directly executable including the said programs which are compressed are executable after being decompressed. This also includes the case of execution in combination with other programs such as operating system and library. The term "storing medium" refers to a medium for storing programs such as a floppy disk, a CD-ROM, a hard disk, and so on.

In an embodiment of the present invention, the sound source generation device, the speech synthesis device, and the speech processing method are characterized by adopting not only the accent command but also the descent command as elements for controlling fundamental frequency. Thus, according to this embodiment of the present invention, fundamental frequency is controlled more precisely, and more expressive sound source generation and speech synthesis is implemented.

In an embodiment of the present invention, the sound source generation device, the speech synthesis device, and the speech processing method are characterized by further adopting the rhythm command as an element for controlling fundamental frequency. Thus, with this embodiment, fundamental frequency is controlled more precisely, and more expressive sound source generation and speech synthesis is implemented.

In an embodiment of the present invention, the speech analyzing method is characterized by carrying out analysis using not only the accent command but also the descent command as elements for analyzing fundamental frequency. Thus, with this embodiment, speech characteristics are more precisely analyzable.

In an embodiment of the present invention, the speech analyzing method is characterized by further adopting the rhythm command as an element for analyzing fundamental frequency. Thus, speech characteristics are more precisely analyzable.

Additional objects, advantages and novel features of the invention will be set forth in part in the description that follows, and in part will become more apparent to those skilled in the art upon examination of the following or upon learning by practice of the invention.

BRIEF DESCRIPTION OF THE DRAWINGS

In the figures:

FIG. 4A shows the contents of a word dictionary for an embodiment of the present invention;

FIG. 4B shows the contents of a dictionary of syllable duration for an embodiment of the present invention;

FIG. 4C shows the result of syllable analysis for an embodiment of the present invention;

FIG. 4D shows the contents of a dictionary of voiced/unvoiced sounds of consonants/vowels for an embodiment of the present invention;

FIG. 4F shows the contents of phoneme dictionary for an embodiment of the present invention;

DETAILED DESCRIPTION

Fundamental Frequency Generation Model

In order to describe an embodiment of the sound source generation device of the present invention, a description of the fundamental frequency generation model used for the device is necessary. This model is as follows.

In order to obtain the calculation model of fundamental frequency, which is based on the assumption that the movements of muscles and bones in the larynx area can be approximated by the counter relation of two movements of a mechanism of vocal folds stretch and contraction, these physiological movements are converted to a simplified model, and then the model is converted into a mathematical expression, which can be controlled with some given parameters.

Relationship between Fundamental Frequency and Vocal Folds

Regarding the vocal folds as a spring, the relation between vibration frequency (f0) and tension (T) is $$f0=a\sqrt{T}$$

Experimentally, it has been proven that the relation between a muscle's tension and stretch (x) is described by the following equation:

$$\frac{dT}{dx} = bT + c$$

where a, b and c are constants. Given these initial conditions, when x=0, and T=0, this equation is solved as follows:

$$T = \frac{c}{b}(\exp(bx) - 1)$$
$$\approx \frac{c}{b}\exp(bx) \text{ as } \exp(bx) >> 1$$

According to the above two equations:

$$\ln f0 = \frac{b}{2}x + \ln\left(\sqrt{\frac{c}{b}}\,a\right) \quad (1)$$
$$= c_1 x + c_2$$
$$c_1 = \frac{b}{2},\ c_2 = \ln\left(\sqrt{\frac{c}{b}}\,a\right) \text{ is derived.}$$

It is clear from the above equations that the logarithm of fundamental frequency is proportional to the extension of the vocal folds (x). Thus, the fundamental frequency can be controlled if how the vocal folds extension is affected by movements of muscles and bones in the larynx area can be represented in the model.

Physiological Mechanism of the Larynx Movements

Figure 11:
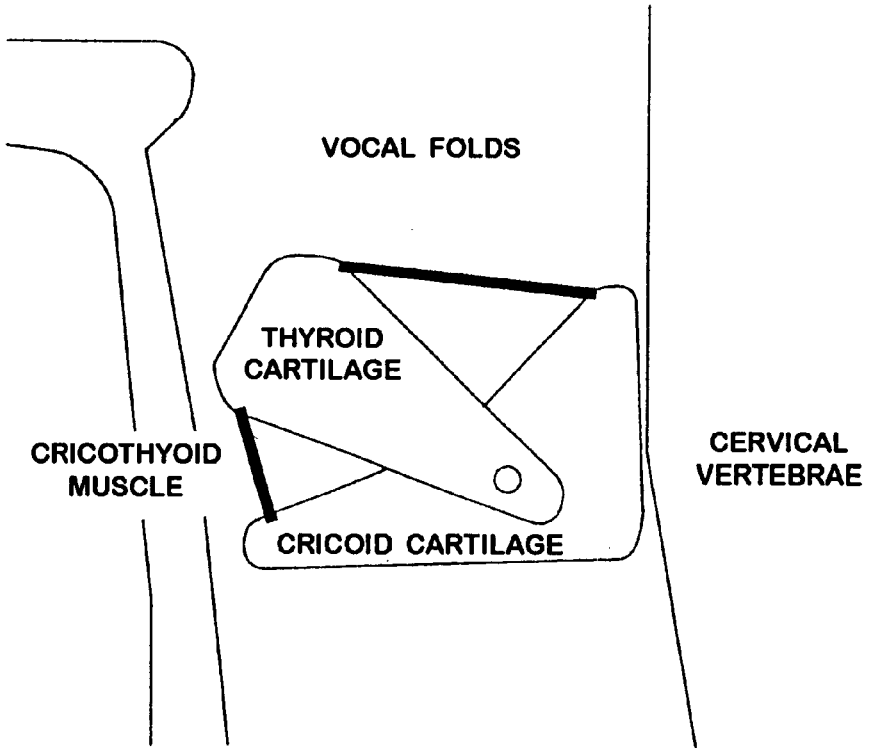
FIG. 11 shows the model of the larynx for an embodiment of the present invention.

FIG. 11 shows a schematic model of muscles and cartilage around the vocal folds area. The thyroid cartilage and the cricoid cartilage are connected by the cricothyroid muscle and the vocal folds.

Figure 12:
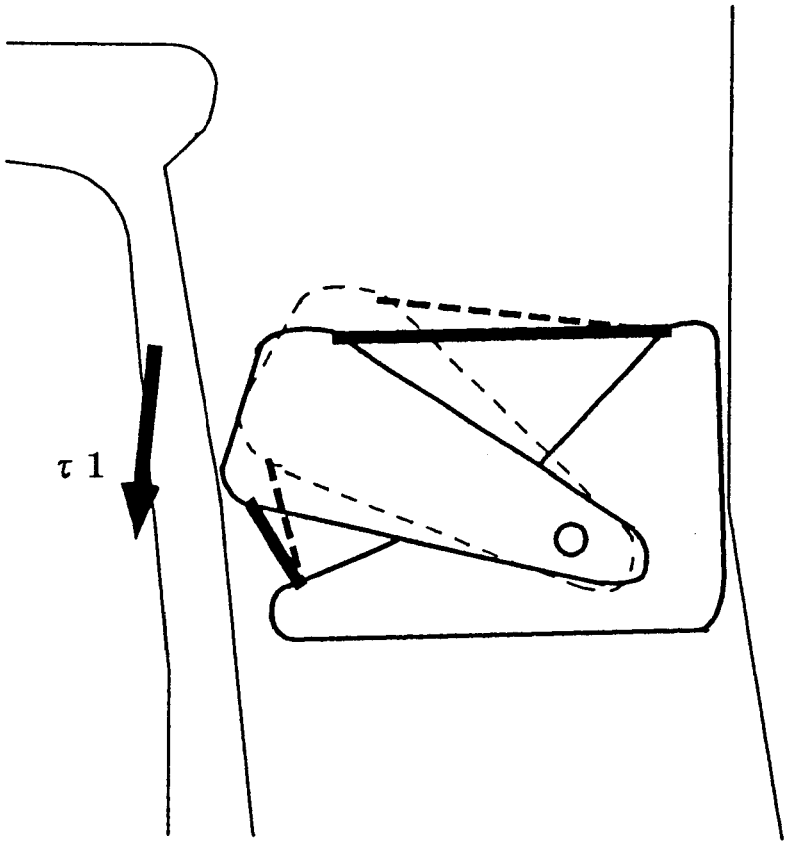
FIG. 12 shows the mechanism of raising fundamental frequency for an embodiment of the present invention.
Figure 13:
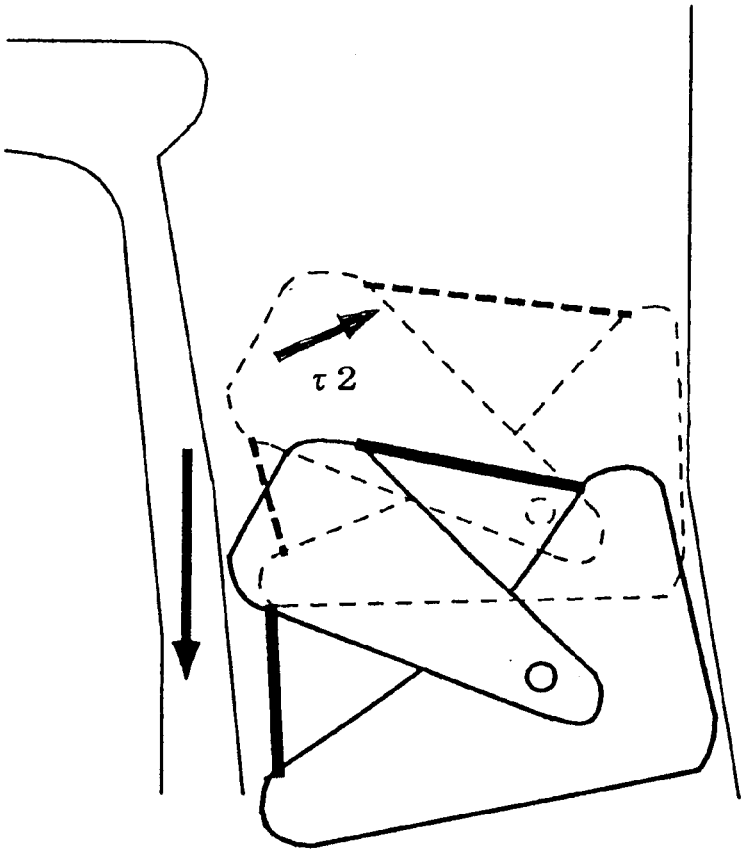
FIG. 13 shows the mechanism of lowering fundamental frequency for an embodiment of the present invention.

Analyzing the movements around the vocal folds area during speech production, the following three movements of muscles and bones are considered to have the greatest effect on vocal folds stretch and contraction: 1) when the cricothyroid muscle contracts, the thyroid cartilage rotates, and the vocal folds are stretched (see FIG. 12); 2) when the sternohyoid muscle lowers the larynx along the vertebrae, the cricoid cartilage rotates, and then the vocal folds contract (see FIG. 13); and 3) when the muscle between the hyoid bone, which is situated in front of the thyroid cartilage, and the thyroid cartilage, contracts, the thyroid cartilage rotates, and the vocal folds are stretched.

The first and third movements are encompassed in the Fujisaki Model. The second movement is newly considered and applied by the fundamental frequency generation model of an embodiment of the present invention.

Although both the first and third movements involve the stretch of vocal folds, the third is less effective than the first and supplementary to it. Therefore, the third movement is best considered in conjunction with the first movement.

Accordingly, an embodiment of the present invention assumes that the variation of the vocal folds stretch is affected by two forces: 1) a force ($\tau 1$) that causes the thyroid cartilage to rotate, by virtue of cricothyroid muscle contraction, toward the vocal folds stretch; and 2) a force ($\tau 2$) that causes the cricoid cartilage to rotate toward the vocal folds contraction.

Mathematical Expression of Movements in the Model

Figure 14:
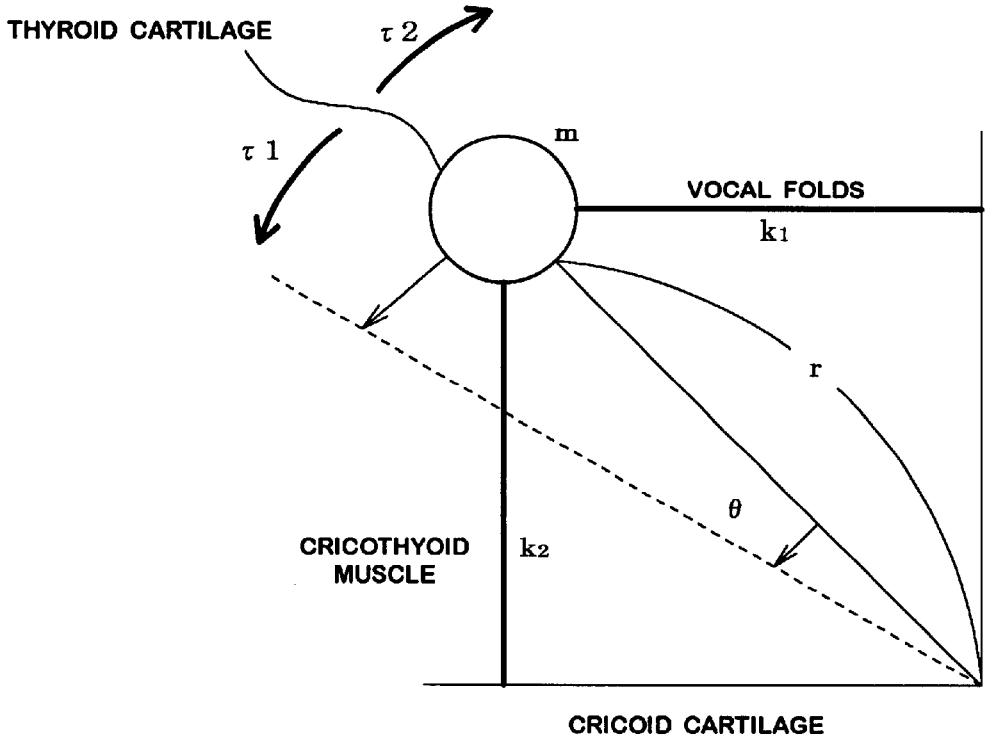
FIG. 14 shows the larynx model using springs according to an embodiment of the present invention.
Figure 15:
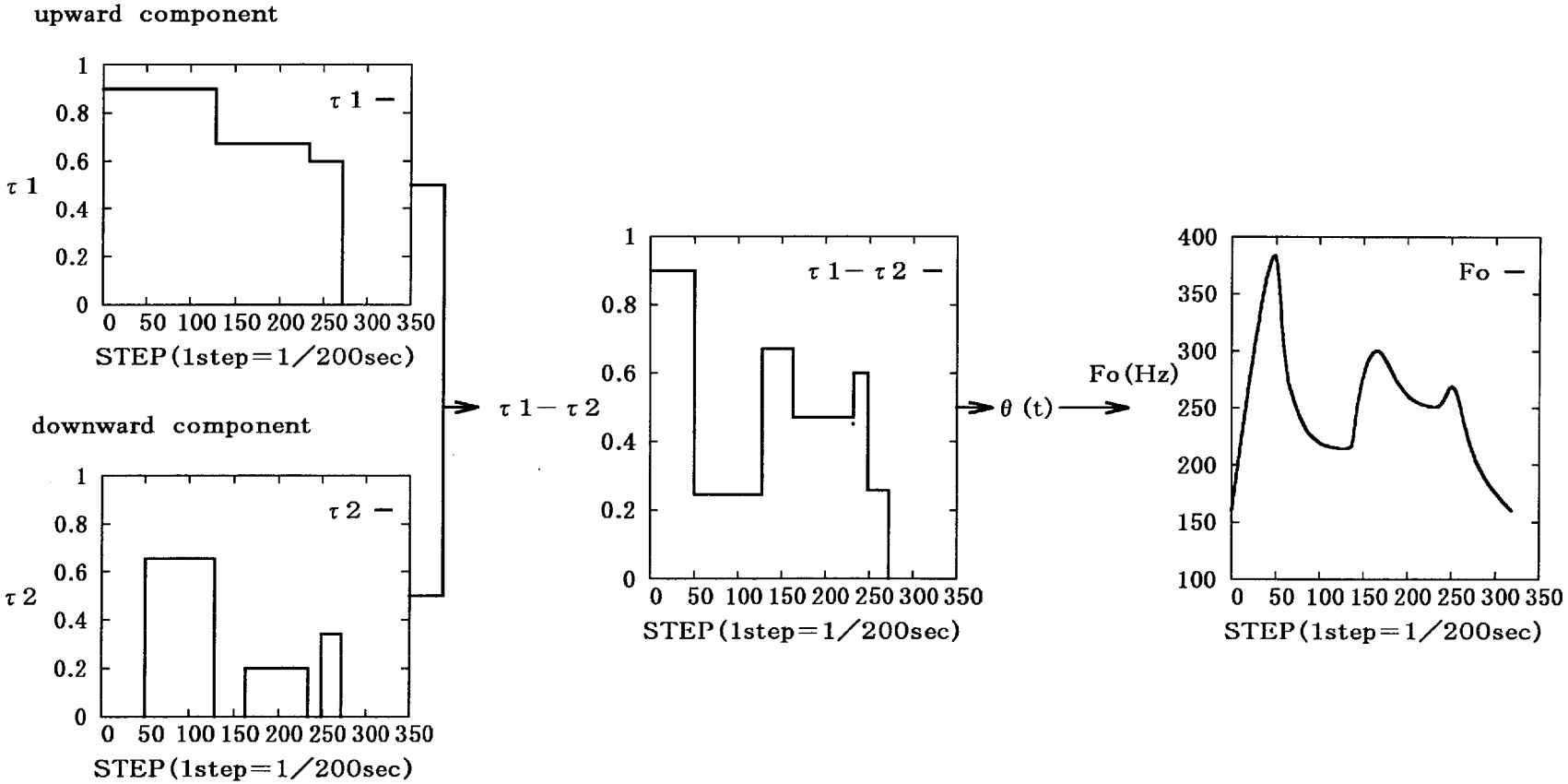
FIG. 15 shows a force $\tau 1$, a force $\tau 2$ and fundamental frequency for an embodiment of the present invention.

In order to obtain the mathematical expression of the fundamental frequency generation model, as described above, and to control the model using parameters $\tau 1$ and $\tau 2$, a more simplified structure is substituted, which assumes that muscles in the model are springs and that the thyroid cartilage is an object rotating at a fixed distance (FIG. 14).

In FIG. 14, $\tau 1$ denotes the force in the direction of stretch of the vocal folds in order to raise fundamental frequency; $\tau 2$ denotes the force in the direction of contraction of the vocal folds in order to lower fundamental frequency; $\theta$ denotes the angle of rotation of the thyroid cartilage; m and r denote the mass and the length of the thyroid cartilage, respectively; R denotes the resistance when the thyroid cartilage rotates; and k1 and k2 denote the spring constants of the vocal folds and the cricothyroid muscle, respectively, when modeled as springs. Although $\tau 1$ and $\tau 2$ vary with time, they are assumed here to be invariant with time in order to solve differential equation (2), below, in a simple manner.

In this model, considering the force balance of rotating direction, the following equation applies.

$$mr^2[[\$]\$^{\cdot\cdot}g\ddot{\theta} = -R\theta - (c_3K_1 + c_4k_2)\theta + (\tau_2\tau_1)$$
$$\therefore mr^2[[\$]\$^{\cdot\cdot}g\ddot{\theta} + R\theta + K\theta = \tau \quad (2)$$
$$K = c_3k_1 + c_4k_2,\ \tau = \tau_2 - \tau_1,$$

where $C_3$ and $C_4$ are constants.

$$mr^2[[\$]\$^{\cdot\cdot}g\ddot{\theta} + R\theta + K\theta = 0,$$

supplemental equation.

A set of fundamental solutions ($\theta$ 1, $\theta$ 2) for the supplemental equation and one particular solution ($\eta$) for the equation (2) are next obtained, so that the solution of this inhomogeneous linear differential equation of second order is described as follows:

$$\theta(t)=c_5\theta 1+c_6\theta 2+\eta \quad (3),$$

where $c_5$ and $c_6$ are constants.

The supplemental equation then is considered in order to obtain the fundamental solution.

Next, assuming that the solution of this equation is the critical damping, the fundamental solution becomes:

$$\theta 1(t) = \exp(-\beta t),\ \theta 2(t) = t\exp(-\beta t) \quad (4)$$

$$\beta = \frac{R}{2mr^2}.$$

If the particular solution for the equation (2) is set as follows:

$$\eta=\theta(t)At^2+Bt+C,$$

the following are then derived:

$$\theta=2At+B$$

$$\bar{\theta}=2A.$$

Substituting these into the equation (2) produces the following:

$$kAt^2+(2RA+KB)t+2mr^2A+RB+KC-\tau=0.$$

Since this holds for any t, the following are derived:

$$kA = 0$$

$$2RA + KB = 0$$

$$2mr^2A + RB + KC - \tau = 0 \quad \therefore\ A = 0,\ B = 0,\ C = \frac{\tau}{K}.$$

Therefore, the particular solution is described as follows:

$$\eta = \frac{\tau}{K}. \quad (5)$$

According to equations (3), (4), and (5), the fundamental solution for the equation (2) is described as follows:

$$\begin{aligned}\theta(t) &= c_5\theta 1 + c_6\theta 2 + \eta \quad (6)\\ &= c_5\exp(-\beta t) + c_6 t\exp(-\beta t) + \frac{\tau}{K}\\ &= (c_5 + c_6 t)\exp(-\beta t) + \frac{\tau}{K}\end{aligned}$$

$$\therefore\ \dot{\theta}(t) = \{-\beta c_5 + (1 - \beta t)c_6\}\exp(-\beta t). \quad (7)$$

From the initial conditions, given θo, and θ=θo at t=0, the following are derived:

$$\theta(0) = c_5 + \frac{\tau}{K} = \theta_0 \quad \therefore\ c_5 = \theta_0 - \frac{\tau}{K}$$

$$\dot{\theta}(0) = -\beta c_5 + c_6 = \dot{\theta}_0 \quad \therefore\ c_6 = \beta c_5 + \dot{\theta}_0 = \beta\theta_0 - \beta\frac{\tau}{K} + \dot{\theta}_0.$$

Substituting derived $c_5$ and $c_6$ from above into equations (6) and (7) produces the following:

$$\theta(t) = \frac{\tau}{K}\{1 - (1 + \beta t)\exp(-\beta t)\} + \{\dot{\theta}_0 t + (1 + \beta t)\theta_0\}\exp(-\beta t) \quad (8)$$

$$\dot{\theta}(t) = \left\{-\beta\left(\theta_0 - \frac{\tau}{K}\right) + (1 - \beta t)\left(\beta\theta_0 - \beta\frac{\tau}{K} + \dot{\theta}_0\right)\right\}\exp(-\beta t). \quad (9)$$

If θ is a minute value, $x=c_7\theta$ is derived since x and θ may be regarded as proportional. Substituting this equation into equation (1) with $Inf0=c_1x+c_2$, produces the following:

$$\ln f0(t)=c_1c_7\theta(t)+c_2=c_8\theta(t)+c_2 \quad (10)$$

$$c_8=c_1c_7.$$

Although the value of $c_8$ cannot be obtained without analyzing sampling data, in this case, $c_8=1$ is assumed for the simplicity of the equation.

Based on the above calculations, the following is determined:

$$\begin{aligned}\ln f0(t) &= \theta(t) + c_2 \quad (11)\\ &= \alpha\{1 - (1 + \beta t)\exp(-\beta t)\} +\\ &\quad \{\dot{\theta}_0 t + (1 + \beta t)\theta_0\}\exp(-\beta t) + C_2.\end{aligned}$$

$$\alpha = \frac{\tau}{K}.$$

Therefore, $$f0(t)=f_{default}\times\exp\{\alpha\{1-(1+\beta t)\exp(-\beta t)\}+\{\dot{\theta}_0 t+(1+\beta t)\theta_0\}\exp(-\beta t)\} \quad (12)$$

$$f_{default}=\exp(c_2) \quad (13),$$

where $f_{default}$ is the fundamental frequency, given that forces (τ1, τ2) corresponding to fundamental frequency changes are not present and β is a constant that varies depending on a talker.

It is apparent from equation (12) that the angle of thyroid cartilage rotation and the stretch of the vocal folds can be calculated using the counter relation between a force (τ1) in the direction to raise the fundamental frequency and a force (τ2) in the direction to lower the fundamental frequency, and consequently fundamental frequency changes can be determined.

Implementation

Fundamental frequency can be calculated by inputting parameters α(=(τ1−τ2)/K) into equation (12). However, to obtain the solution for equation (12) simply, in the equation (2), τ1 and τ2 are assumed as constants that are invariant with time. However, τ1 and τ2 are actually variables with time because muscles and bones are moving during utterances.

Assuming that time t takes on a discrete value as t=nΔt (n=0,1,2,3 . . . ) and τ1, τ2, and α have arbitrary values in every infinitesimal time Δt, equations (8), (9), and (12) may be rewritten, respectively, as follows.

$$\theta(n\Delta t)=\alpha(n\Delta t)\{1-(1+\beta\Delta t)\exp(-\beta\Delta t)\}+\{\dot{\theta}((n-1)\Delta t)\Delta t+(1+\beta\Delta t)\theta((n-1)\Delta t)\}\exp(-\beta\Delta t) \quad (14)$$

$$\dot{\theta}(n\Delta t)=\{-\beta(\theta((n-1)\Delta t)-\alpha(n\Delta t))+(1-\beta\Delta t)(\beta\theta((n-1)\Delta t)-\alpha(n\Delta t)\times\beta+\dot{\theta}((n-1)\Delta t))\}\exp(-\beta\Delta t) \quad (15)$$

$$f0(n\Delta t)=f_{default}\times\exp\{\alpha(n\Delta t)\{1-(1+\beta\Delta t)\exp(-\beta\Delta t)\}+\{\dot{\theta}((n-1)\Delta t)\Delta t+(1+\beta\Delta t)\theta((n-1)\Delta t)\}\exp(-\beta\Delta t)\} \quad (16)$$

And θ(nΔt), $\dot{\theta}$(nΔt), f0(nΔt) can be calculated from equations (14), (15) and (16), if θ((n−1)Δt), $\dot{\theta}$((N−1)Δt), α(nΔt) is determined.

Consequently, f0(nΔt)(n=0,1,2,3, . . . ) for an arbitrary time can be calculated by supplying f0(nΔt)(n=0,1,2,3 . . . ) for input.

Generating Method of Fundamental Frequency Patterns

The above description provides the mathematical expression of the model for an embodiment of the present invention and the inputs for generating patterns of time curves of fundamental frequency. The method to determine the input parameters will now be described.

The characteristic of accents in Tokyo dialect is that there is always a fundamental frequency rise or fall from the first mora through the second mora, and a fall in fundamental frequency happens definitely once in a word.

The "accent dictionary," which is based on this rule, indicates the basic accent points of words. For example, a sentence "/ka re no imooto ga kekkon suru/", which means "his sister is going to marry," is exhibited with a dotted pitch pattern indicating that the fundamental frequency rises and falls in each syllable, as shown in FIG. 16.

Figure 16:
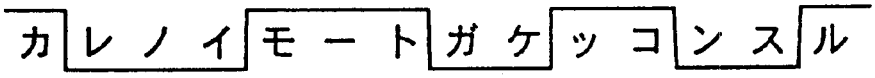
FIG. 16 shows a dotted pitch pattern for an embodiment of the present invention.
Figure 17:
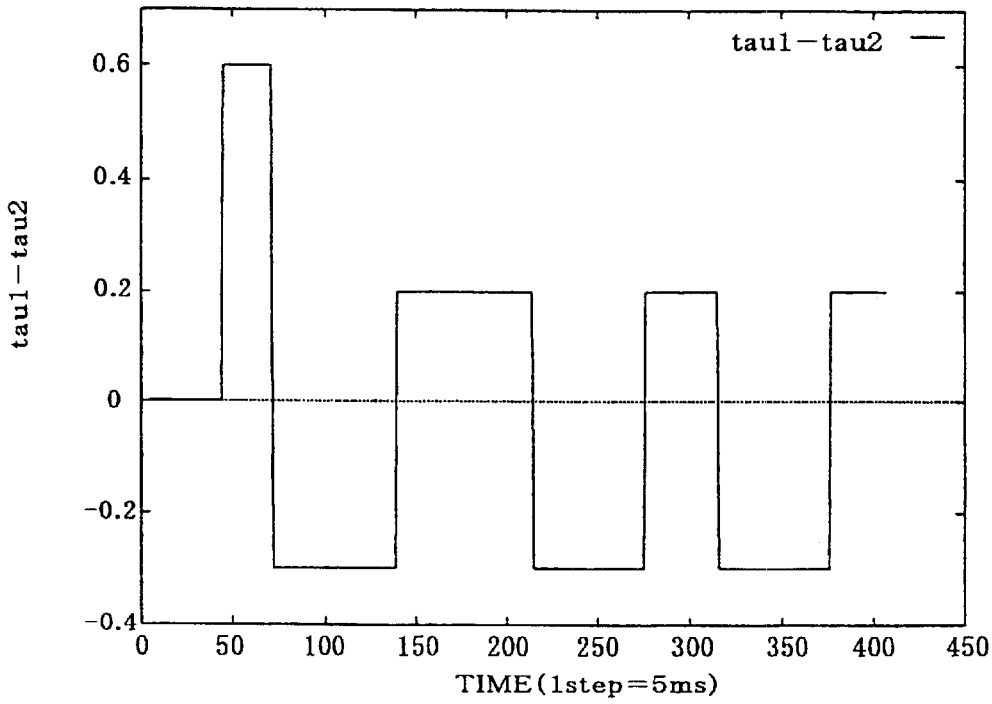
FIG. 17 shows $\tau 1$–$\tau 2$ for an embodiment of the present invention.

In an embodiment of the present invention, analyzing the speech utterance, the starting point and the duration of an utterance for each syllable are examined, and comparing the height of the rectangular patterns of accent of FIG. 16 and extracted data (FIG.17), and then the value of $\alpha$ is determined (see FIG. 17). As shown in FIG. 17, the force $\tau 1$ is greater than the force $\tau 2$ in the area where the value is positive and the force $\tau 2$ is greater in the area where the value is negative.

Figure 18:
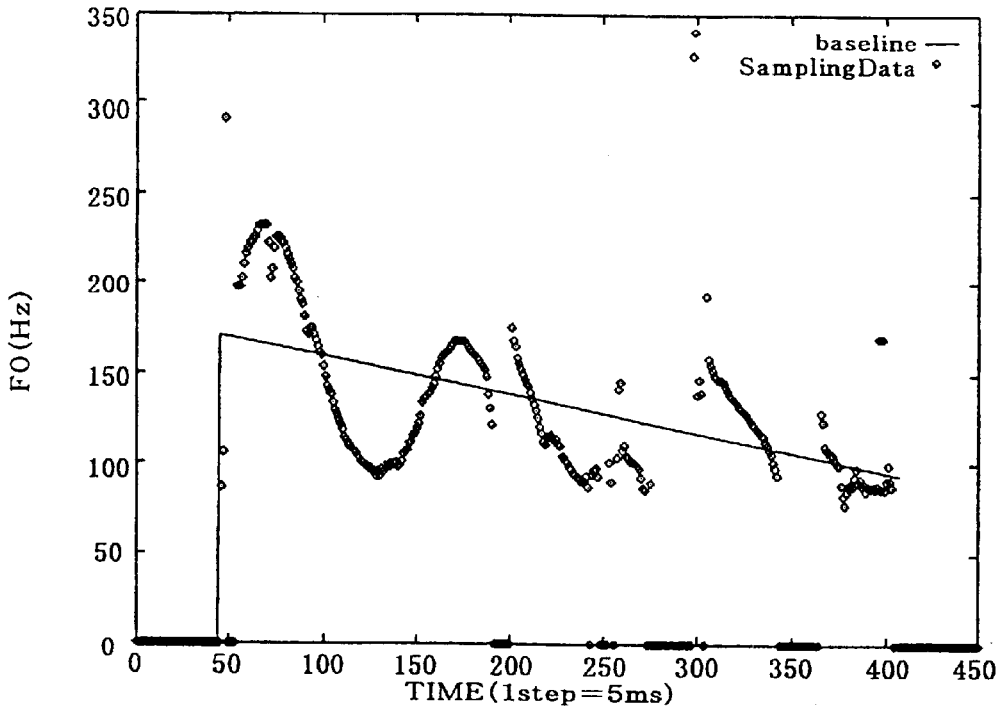
FIG. 18 is a straight line indicating the inclination of fundamental frequency for an embodiment of the present invention.

Tokyo dialect has the observed phenomenon of fundamental frequency moderately falling from the beginning through the end of a phrase. In order to obtain this overall change pattern of curves, in an embodiment of the present invention, an approximate straight line of fundamental frequency patterns extracted from the speech sampling data is derived using the least squares method (FIG. 18).

Figure 19:
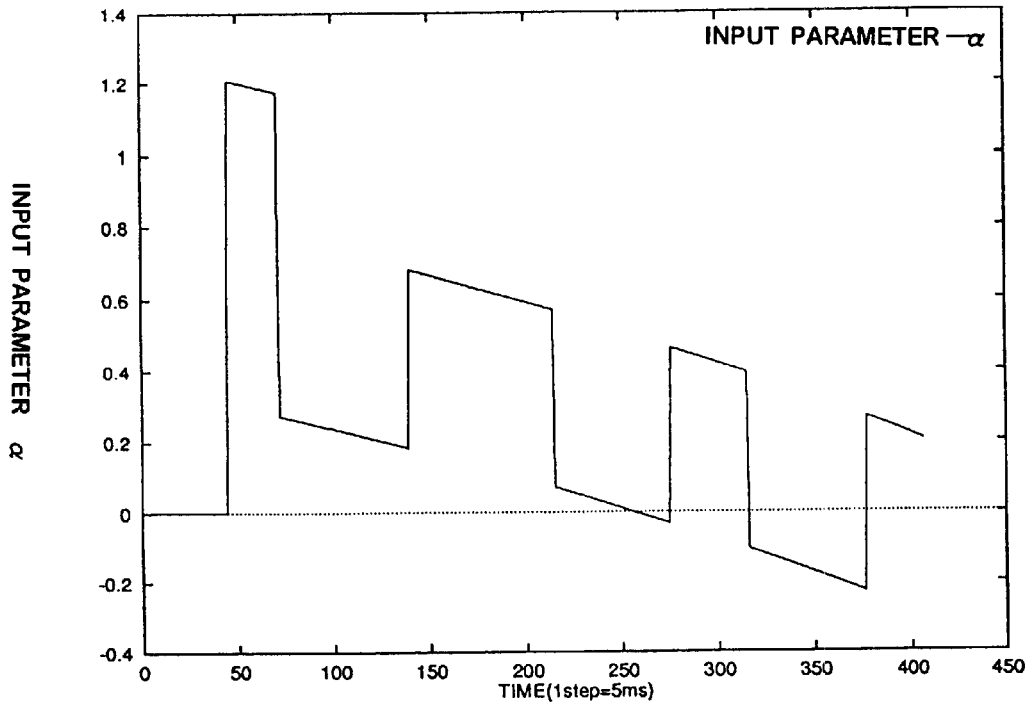
FIG. 19 shows input parameters for the fundamental frequency generation model according to an embodiment of the present invention.
Figure 20:
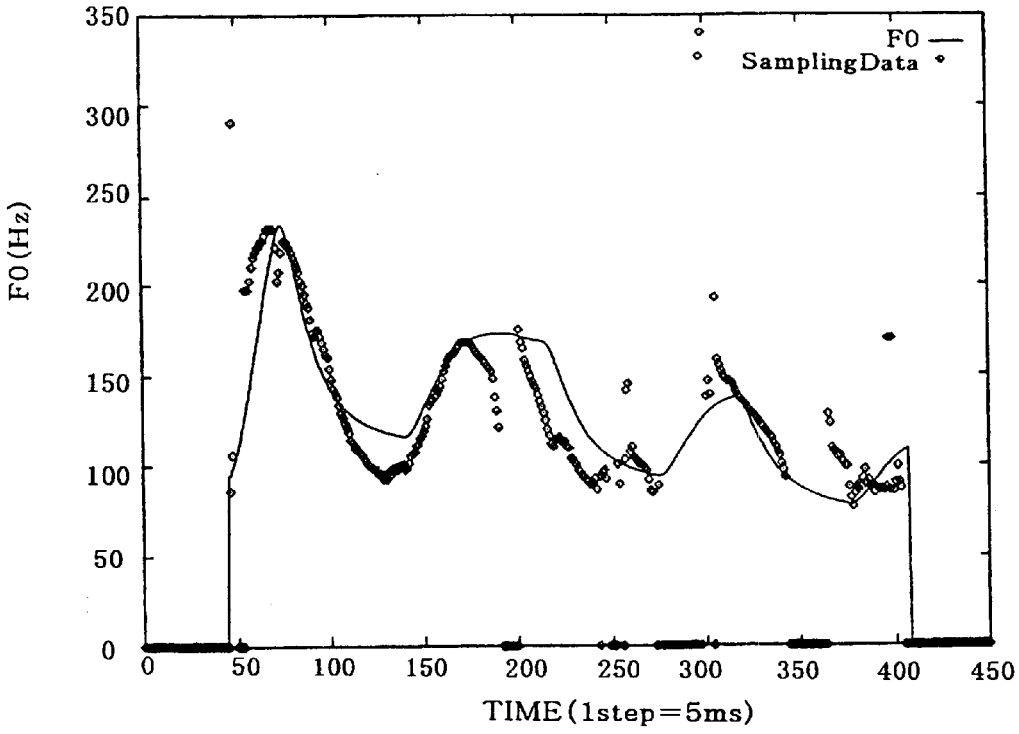
FIG. 20 shows calculated results and the sampling data of fundamental frequency for an embodiment of the present invention.

Fundamental frequency patterns, which are indicated by a solid line (FIG. 20), are obtained by inputting the sum (FIG. 19) of the value of $\tau 1-\tau 2$ (FIG. 17), obtained by the above method, and the value of overall change (FIG. 18), into the model as final input parameters.

Approximation Results of Fundamental Frequency

Next described are the results of the best approximation of fundamental frequency extracted from speech utterance data containing various "prominence", using the fundamental frequency generation model of an embodiment of the present invention.

Approximation Patterns Using Fundamental Frequency Generation Model

Speech utterance data used for analysis modeling for an embodiment of the present invention include 78 short sentences of 13 types pronounced by a male announcer and a female announcer. An assertive sentence and one to four kinds of sentences containing "prominence" were prepared for each of the short sentences.

Figure 21:
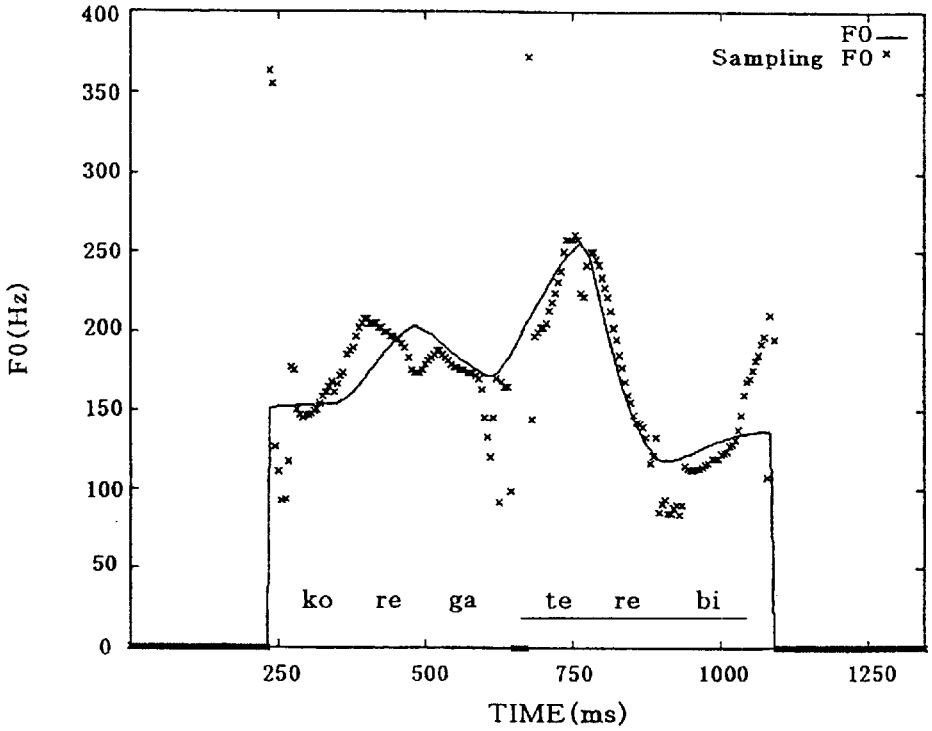
FIG. 21 shows speech utterance by a male for an embodiment of the present invention.
Figure 22:
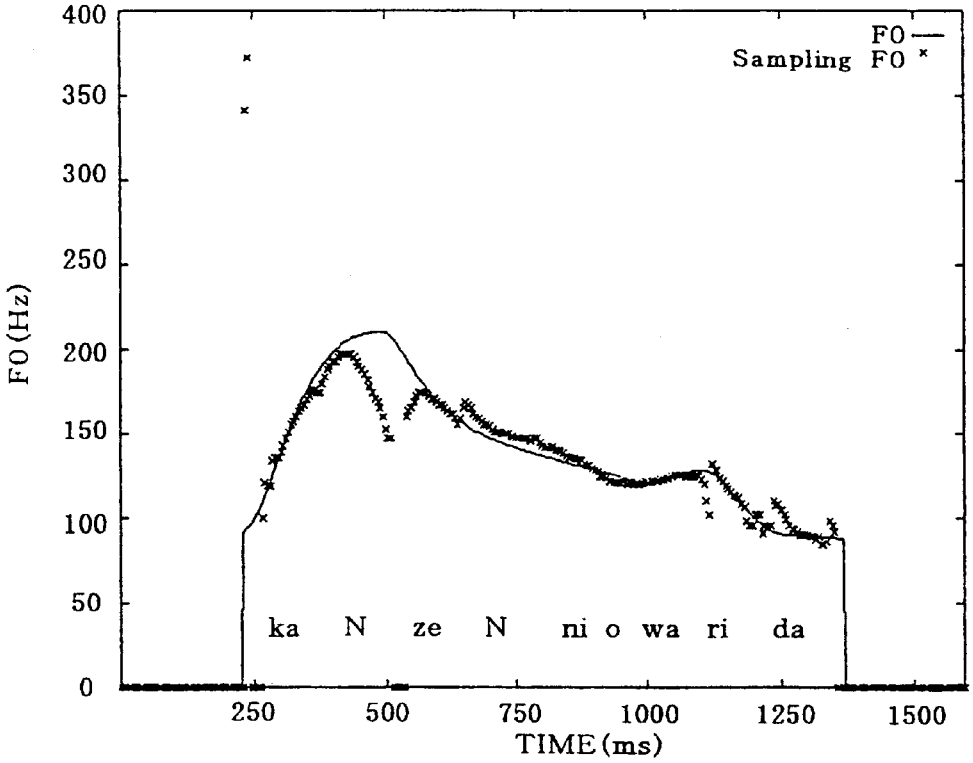
FIG. 22 shows speech utterance by a male for an embodiment of the present invention.
Figure 23:
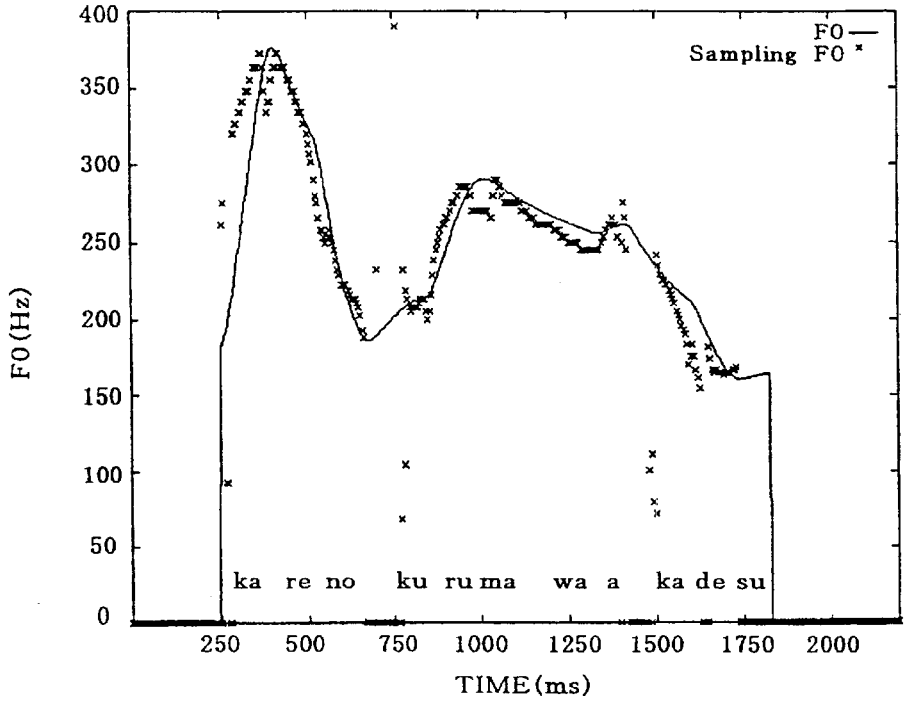
FIG. 23 shows speech utterance by a female for an embodiment of the present invention.
Figure 24:
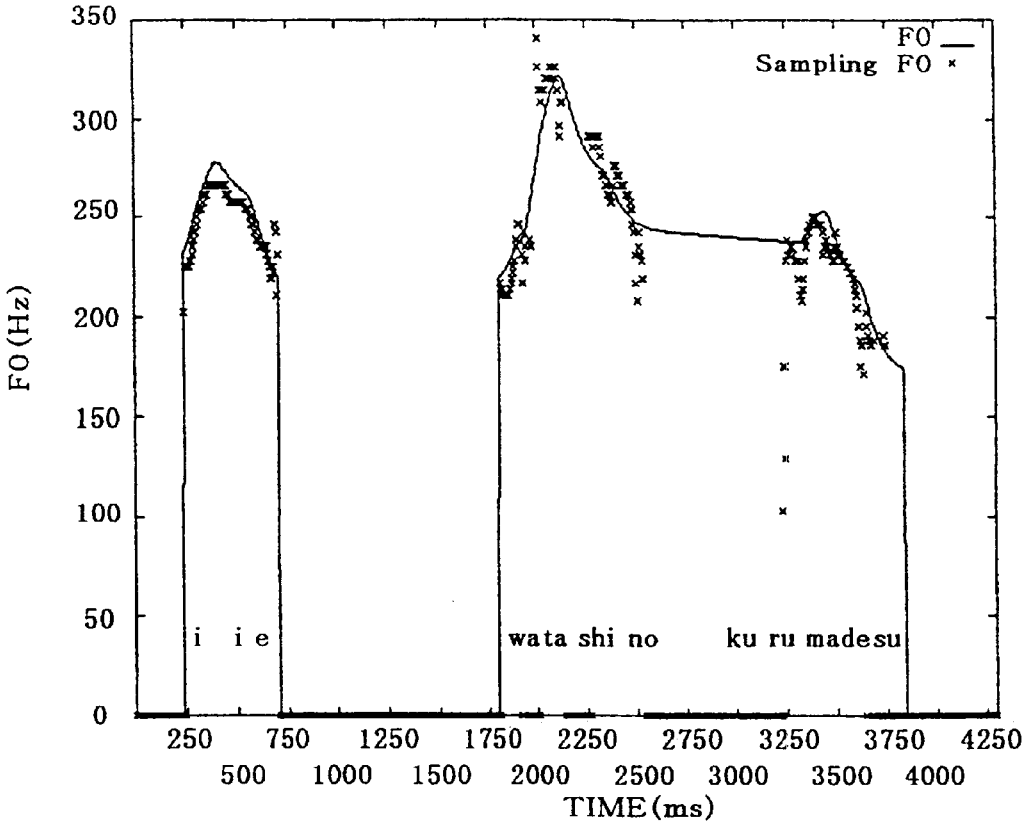
FIG. 24 shows speech utterance by a female for an embodiment of the present invention.

The percentage of approximation errors between the fundamental frequency extracted from these speech utterances and the fundamental frequency generated using the fundamental frequency generation model of an embodiment of the present invention averages 5.8% in male utterance data and 4.0% in female utterance data. FIGS. 21 and 23 show the approximation data with the lowest precision of fundamental frequency for male and female utterances, respectively, and FIGS. 22 and 24 show those with the highest precision. The points marked by an "X" in FIGS. 22 and 24 represent the extracted fundamental frequency from speech utterance sampling data, and the solid line represents the approximation of fundamental frequency. These graphs confirm that overall change patterns of fundamental frequency can be approximated successfully using the model of an embodiment of the present invention. Approximation errors in the results occur mainly because of delay in fundamental frequency at start-up, generated by using the model, and time lag between when the accent command and the descent command are given, and the instant when the fundamental frequency is actually affected.

Since the extracted fundamental frequency from speech utterances contains errors that occur at the extraction, it is expected that data without these errors will reduce approximation errors.

Factors Affecting Approximation Errors

Approximation errors appear to be caused at least in part by the time lag between when the accent command and the descent command of the fundamental frequency generation model are given and the instant when the changes actually start to occur. Even in the speech utterance by a human being, there is a slight time lag between when the accent and descent command are provided and the instant when fundamental frequency is actually affected.

In the model of an embodiment of the present invention, this time lag is represented with the parameter $\beta$ in equation (4). Since this parameter is dependent on the talker, an accurate value of $\beta$ for the talker of particular recorded data can be obtained only by determining at which value of $\beta$ the very best approximation of fundamental frequency is obtained, while $\beta$ is varied.

The result of analysis using actual data with varied values of $\beta$ confirm that the best approximation of fundamental frequency is obtained when $\beta$ is greater than the expected value ($\beta$=20), for which the above mentioned time lag from input parameters is shortest.

Effectiveness of Fundamental Frequency Generation Model

According to the calculation of approximation error in the fundamental frequency generation model of an embodiment of the present invention, the percentage of error is no more than 9%. Therefore, this model is determined to be accurate for generating fundamental frequency patterns of speech utterance data for assertive sentences and speech utterance data containing "prominence".

Accordingly, a more adequate approximation is available with this model than the prior art with regard to the generation of fundamental frequency patterns for various kinds of speech utterance data.

Application to Other Dialects except Tokyo Dialect

As described above, the Tokyo dialect includes the phenomenon of fundamental frequency moderately descending from the beginning through the end of a phrase. In contrast, in Osaka dialect, this phenomenon cannot always be observed. Generating the fundamental frequency using the model of an embodiment of the present invention requires use of parameters for the rhythm component corresponding to these tendencies in spoken sentences in the Osaka dialect.

The following are characteristics of speech tendency, as observed in overall Japanese speech utterances: 1) it is pronounced by a clause or by a unit of intention; 2) between the units of utterances, there is a "re-start-up of fundamental frequency," raising the fundamental frequency which starts falling; 3) a "re-start-up of fundamental frequency" can occur in the same breath group; and 4) Osaka dialect is spoken with a rhythm specific to a talker.

A sine wave is used to represent simply the above tendency, because a sine wave can approximate "specific speech rhythm" and "re-start-up of fundamental frequency" by using only the amplitude and cycle of the sine wave. A single wavelength of sine wave thus represents the duration from the instant when speech utterances start to the instant when "re-start-up of fundamental frequency" occurs after judging from the speech utterances.

Application Results

Figure 25A:
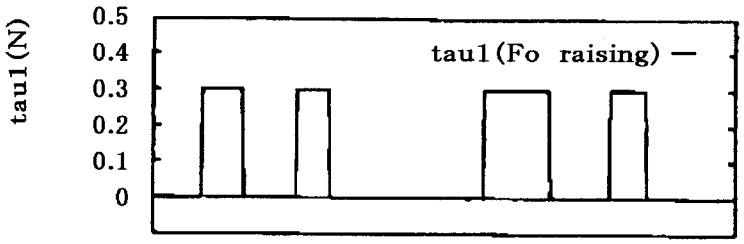
FIG. 25 shows calculated results and the sampling data for the Osaka dialect according to an embodiment of the present invention.
Figure 25B:
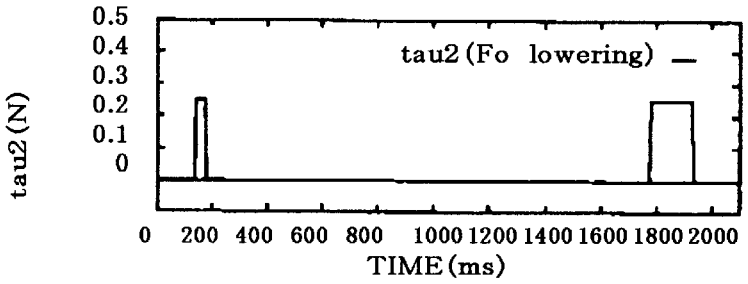
Figure 25C:
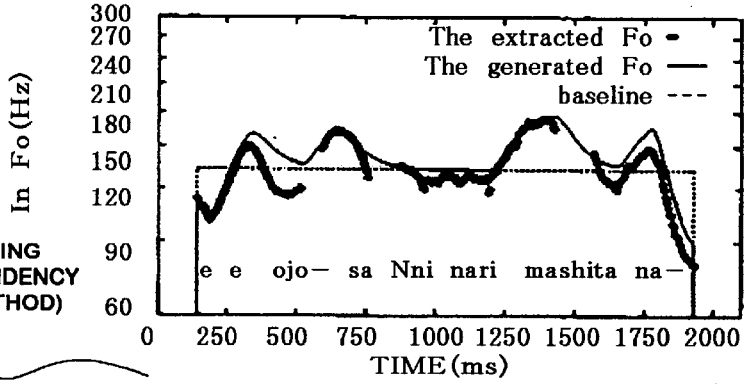
Figure 25D:
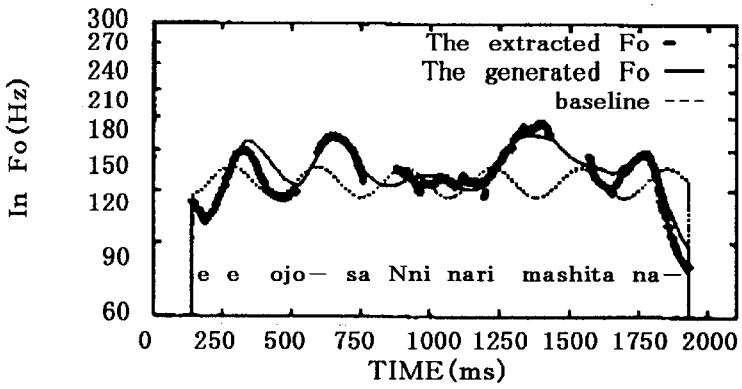

By using a sine wave to approximate parameters of the rhythm component corresponding to this tendency of overall speech utterance, the fundamental frequency generation model of an embodiment of the present invention is applied to a speech utterance of /ee ojo-san ni nari mashita na-/ (which means "what a nice girl she has grown up to be") in Osaka dialect. The results using this parameter, which are presented in FIGS. 25A, and 25B, clearly show the accent command and the descent command, respectively. FIG. 25D shows fundamental frequency patterns (a solid line) generated by using the fundamental frequency generation model of an embodiment of the present invention. The broken lines in FIG. 25D represent the extracted fundamental frequency from speech utterances, and the sine wave representation of the rhythm component is shown with a dotted line. FIG. 25C shows for comparison the same data with parameters indicating a speech tendency using a least squares method instead of a sine wave representation of the rhythm component.

It is clear from FIGS. 25A–25D that the better approximation of fundamental frequency can be obtained by using a sine wave representation of the rhythm component. Furthers the very short cycle of a sine wave also accurately approximates the characteristic in Osaka dialect of a specific rhythm during utterances. Consequently, the speech individuality of fundamental frequency can be analyzed and synthesized by controlling the cycle and amplitude of the sine wave.

Approximations of the fundamental frequency of other dialects or other foreign languages can also be obtained by selecting type of waveform pattern, cycle, and amplitude for the rhythm component. The analysis of the fundamental frequency of other dialects or other foreign languages is thus also practicable.

Device Configuration Example

Based on the fundamental frequency generation model of an embodiment of the present invention, as described above, a sound source generation device and a speech synthesis device can be implemented. If speech is analyzed with consideration of the accent command and the descent command according to the fundamental frequency generation model of this embodiment, more elaborate analysis can be performed.

Figure 1A:
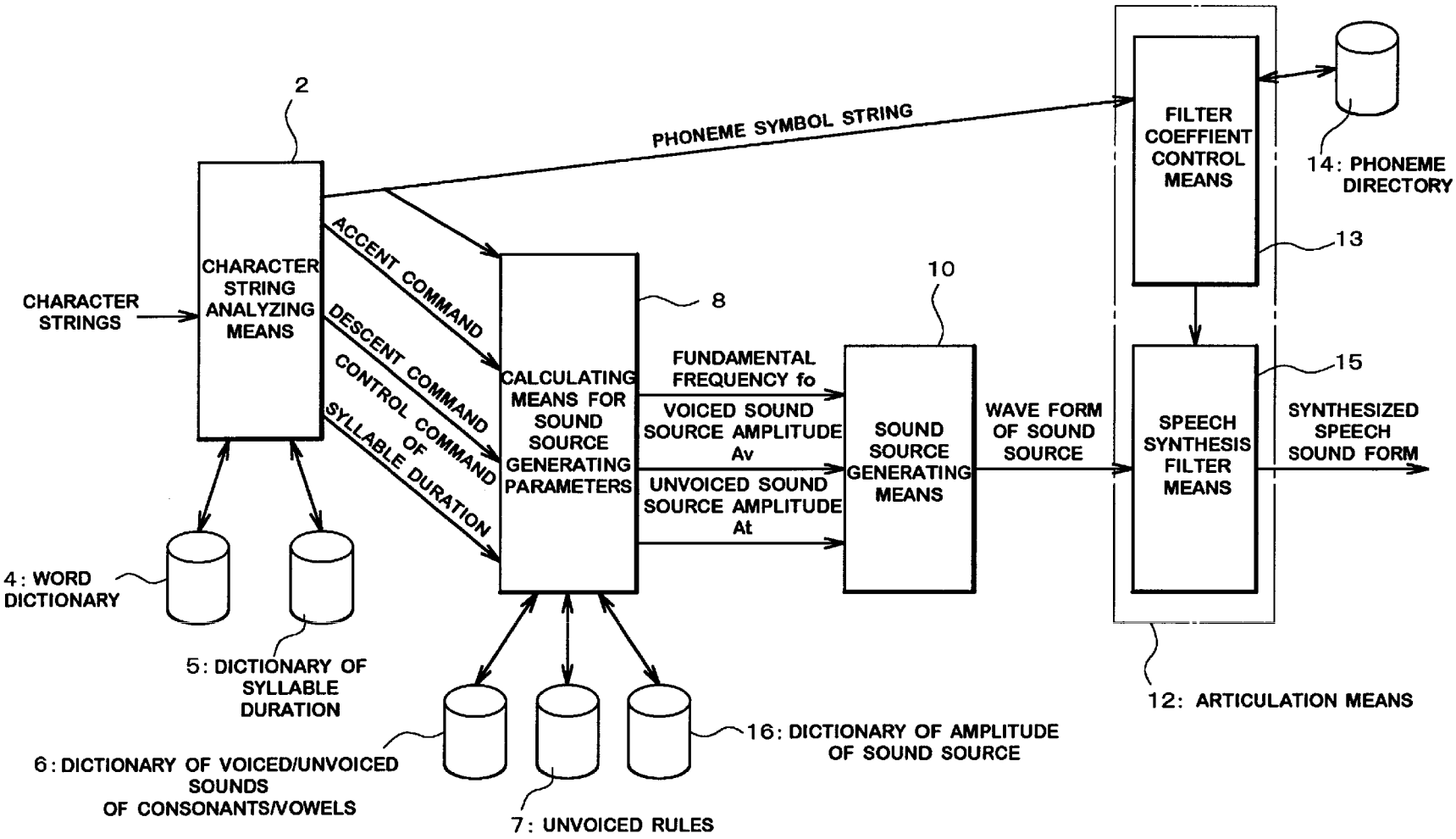
FIG. 1A shows an overall configuration of the speech synthesis device as an embodiment of the present invention.

FIG. 1A shows an overall configuration of the speech synthesis device of an embodiment of the present invention. While, in FIG. 1A, a device for outputting speech sound according to a given character string is shown, this configuration is also applicable to a device for outputting speech sound according to a given concept.

As shown in FIG. 1A, a character string (text) is inputted into the character string analyzing component 2. Upon receiving this character string input, the character string analyzing component 2 performs the morphological analysis, referring to a word dictionary 4, and generates a phoneme symbol string. Further, the character string analyzing component 2 generates a command concerning prosody, such as an accent command, a descent command, and a control command of syllable duration for each syllable, referring to the word dictionary 4 and a dictionary of syllable duration 5. The phoneme symbol string is input into the filter coefficient control component 13, which is within the articulation component 12. This phoneme symbol string is also input into the calculation component for sound source generating parameters 8. The accent command, the descent command, and the control command of syllable duration are input into the calculation component for sound source generating parameters 8.

Using the phoneme symbol string, the calculation component for the sound source generating parameters 8 determines whether each syllable or phoneme is a voiced or unvoiced sound by referring to a dictionary of voiced/unvoiced sounds of consonants/vowels 6. Moreover, this calculation component for the sound source generating parameters 8 also determines which syllable or phoneme can be changed to an unvoiced sound by using unvoiced rules 7. Then, the component 8 determines the time curves of sound source amplitude using reference to a dictionary of amplitude for each phoneme or syllable 16 in accordance with the phoneme symbol string. Further, the calculation component for the sound source generating parameters 8 calculates the time curves of fundamental frequency Fo using the control command of syllable duration, the accent command, the descent command, and the distinction of voiced/unvoiced sounds of consonants/vowels. This component 8 also calculates the time curves of voiced sound source amplitude Av and unvoiced sound source amplitude Af, in accordance with the control command of syllable duration, the voiced/unvoiced distinction of consonants/vowels, and the time curves of sound source amplitude.

A sound source generating component 10 generates and outputs a sound source waveform in accordance with the sound source generating parameters Fo, Av, and Af. This waveform is input into the articulating component 12.

The filter coefficient control component 13, which is within the articulating component 12, obtains the time curves of vocal tract transmission characteristic, which are generated in accordance with the phoneme symbol string produced by the character string analyzing component 2 using reference to the phoneme dictionary. Then, the filter coefficient control component 13 outputs filter coefficients, which implement vocal tract transmission characteristics, to a speech synthesis filter component 15. Thus, the speech synthesis filter component 15 articulates the provided sound source waveform by using vocal tract transmission characteristics, in synchronization with each syllable or phoneme, and outputs a synthesized speech sound waveform. The synthesized speech sound waveform is then converted into analog sound signals by a sound signal output circuit (not shown).

Figure 1B:
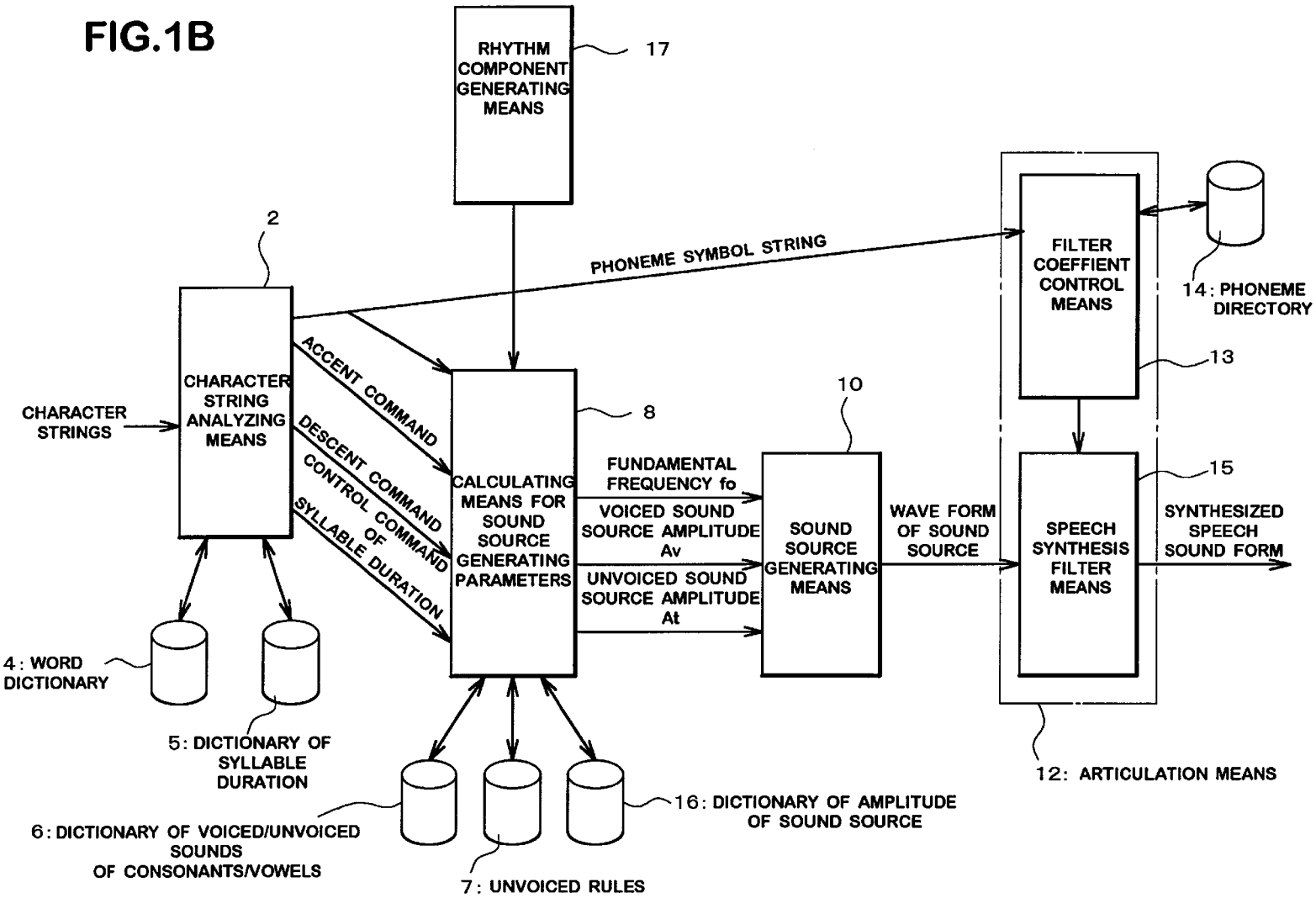
FIG. 1B shows an overall configuration of the speech synthesis device as an embodiment of the present invention.
Figure 2:
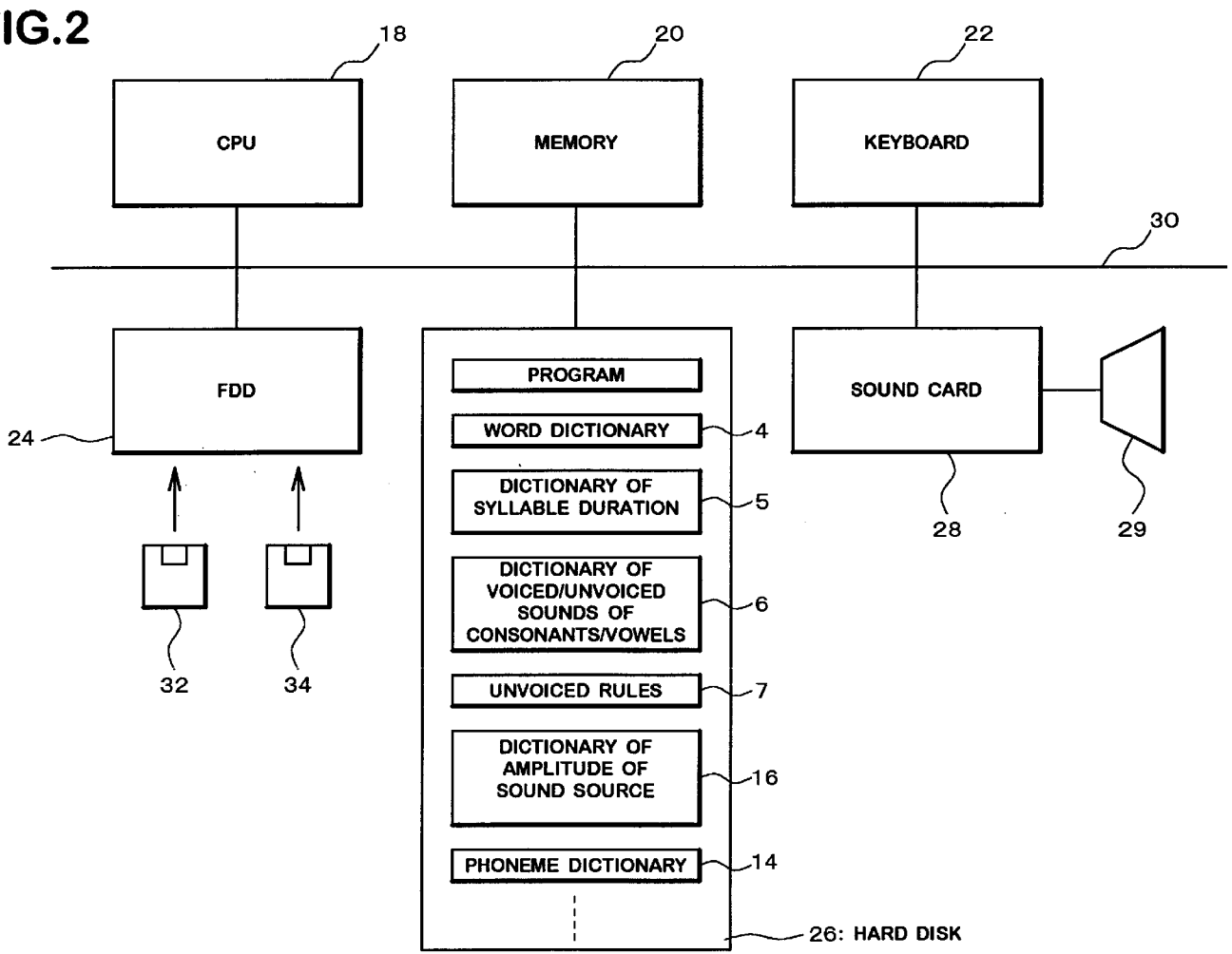
FIG. 2 shows a hardware configuration using a CPU for embodiment of the device shown in FIG. 1.

FIG. 2 shows an embodiment of a hardware configuration for the device of FIG. 1, using a CPU. As shown in FIG. 2, connected to a bus line 30 are a CPU 18, a memory 20, a keyboard 22, a floppy disk drive (FDD) 24, a hard disk 26, and a sound card 28. Programs for character string analysis, calculation of sound source generating parameters, sound source data generation, and articulation are stored on the hard disk 26. These programs are installed from the floppy disk 32 using the FDD 24. A word dictionary 4, a dictionary of syllable duration 5, a dictionary of voiced/unvoiced sounds of consonants/vowels 6, a set of unvoiced rules 7, a dictionary of amplitude for each phoneme or syllable 16, and a phoneme dictionary 14 are also stored on the hard disk 26.

Figure 3:
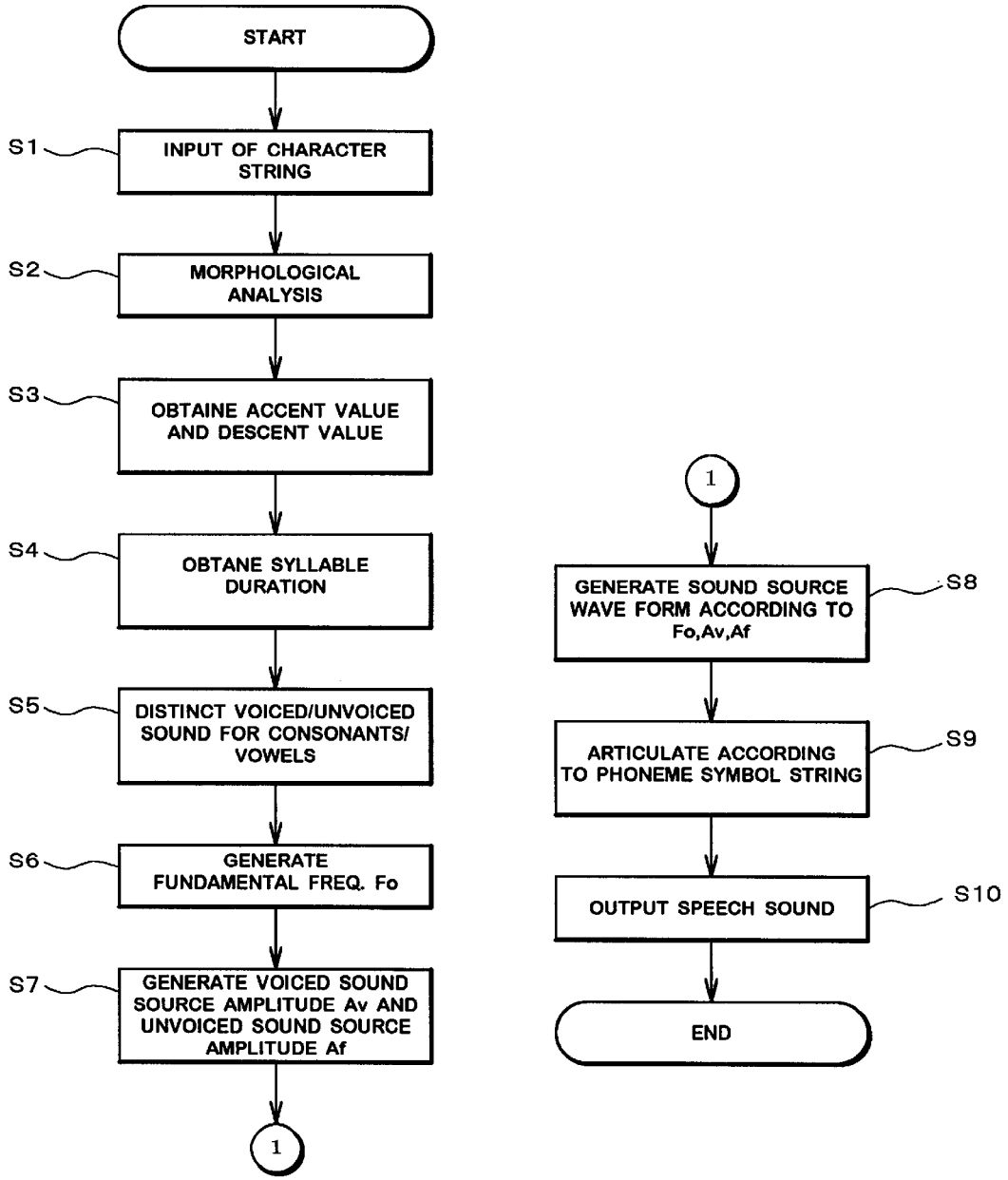
FIG. 3 is a flow of a method for an embodiment of the present invention.

FIG. 3 is a flow chart showing the programs stored in the hard disk 26. As shown in FIG. 3, in the step S1, a character string is inputted using the keyboard 22. Alternatively, a character string of data stored on the floppy disk 34 may be loaded.

Next, the CPU 18 performs morphological analysis of the character string using reference to the word dictionary (step S2). An example of this word dictionary is shown in FIG.

4A. Then, the CPU 18 obtains the pronunciation of the character string, using reference to the word dictionary 4 and break up of the character string into words. For example, when a character string input is made as "ko n ni chi wa", a pronunciation as "koNnichiwa" is obtained. Furthermore, an accent value and a descent value of syllables constituting words are obtained for each word (step S3). Consequently, syllables of "ko" "N" "ni" "chi" "wa" and the accent and descent value for each syllable are obtained. Alternatively, the accent value and the descent value are determined phoneme by phoneme. They are also determinable or correctable using rules based on the relationships among the preceding and succeeding sequences of phonemes or syllables. The relationships between all syllables and their duration, as shown in FIG. 4B, are stored in the dictionary of syllable duration 4 on the hard disk 26. In step S4, the CPU 18 obtains the syllable duration for each syllable of "ko" "N" "ni" "chi" "wa" given in step S2 using reference to the dictionary of syllable duration 4. Accordingly, a table for each syllable is generated, as shown in FIG. 4C.

As shown in FIG. 4D, all phonemes and their distinction of voiced/unvoiced sound are stored in the dictionary of voiced/unvoiced sounds of consonants/vowels 6 on the hard disk 26. In the index of phonemes in FIG. 4D, "V" denotes vowels (voiced sound), "CU" denotes unvoiced sound of consonants and "CV" denotes voiced sound of consonants. The CPU 18 makes a distinction between voiced and unvoiced sound for each phoneme of "k" "o" "N" "i" "c" "h" "i" "w" "a" using reference to the dictionary of voiced/unvoiced sounds of consonants/vowels 6. Furthermore, the CPU 18 determines a voiced sound that changes to an unvoiced sound using reference to the unvoiced rules 7, which are stored with data on cases where voiced sounds change to unvoiced sounds. Thus, each phoneme is evaluated as to whether it contains voiced sound or unvoiced sound (step S5).

Next, the fundamental frequency Fo (time curves) is generated according to the table in FIG. 4C (especially regarding the accent value and the descent value) (step S4). Equation (12), described above, is used to perform this generation. The calculation is carried out with the accent value as $\tau 1$ and the descent value as $\tau 2$. The relation among the accent value, the descent value, and the fundamental frequency Fo is shown as a schematic diagram in FIG. 5. The portions where the fundamental frequency is not calculated indicate the unvoiced sound part.

In this embodiment, the fundamental frequency Fo is determined by the accent value and the descent value.

Figure 4E:
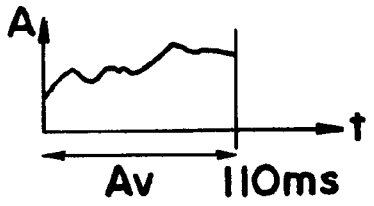
FIG. 4E shows the contents of dictionary of amplitude for each phoneme or syllable for an embodiment of the present invention.
Figure 4E:
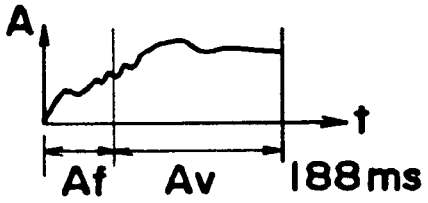
Figure 5:
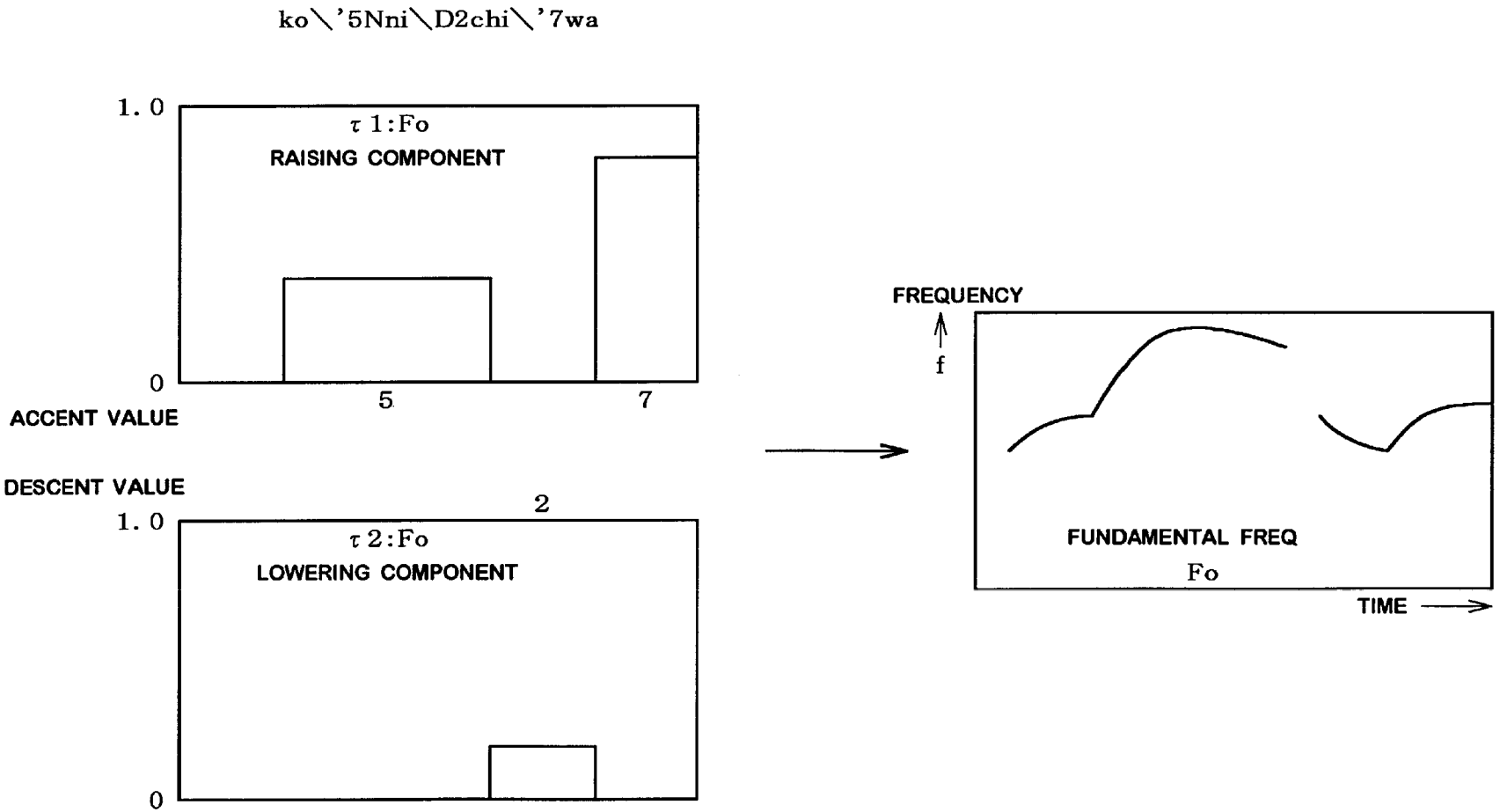
FIG. 5 shows a schematic diagram of accent value, descent value, and the calculated fundamental frequency for an embodiment of the present invention.
Figure 7:
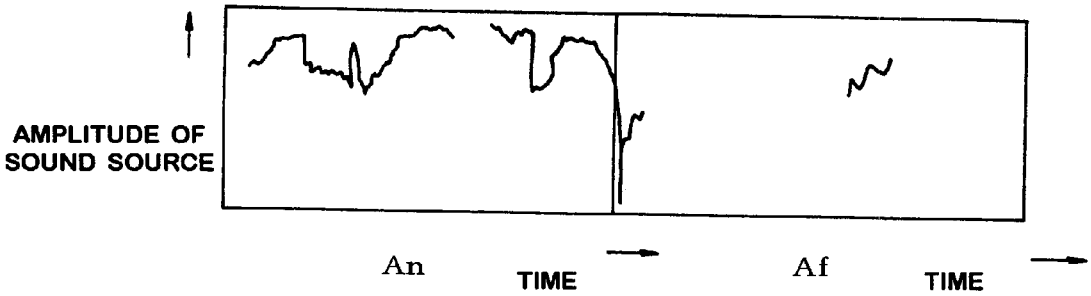
FIG. 7 shows a calculated voiced sound source amplitude Av and unvoiced sound source amplitude Af for an embodiment of the present invention.

The fundamental frequency Fo is thus calculated as above. Next, voiced sound source amplitude Av and unvoiced sound source amplitude Af are calculated (step S7). In the dictionary of amplitude for each phoneme or syllable 16, the time curves of sound source amplitude corresponding to each syllable are stored, as shown in FIG. 4E. The CPU 18, referring to this dictionary, determines voiced sound source amplitude Av and unvoiced sound source amplitude Af for each syllable of"ko" "N" "ni" "chi" and "wa". Also, since the voice/unvoiced distinction is necessary, sound source amplitude for voiced sound is calculated as Av and unvoiced sound is calculated as Af (FIG. 7).

Figure 8:
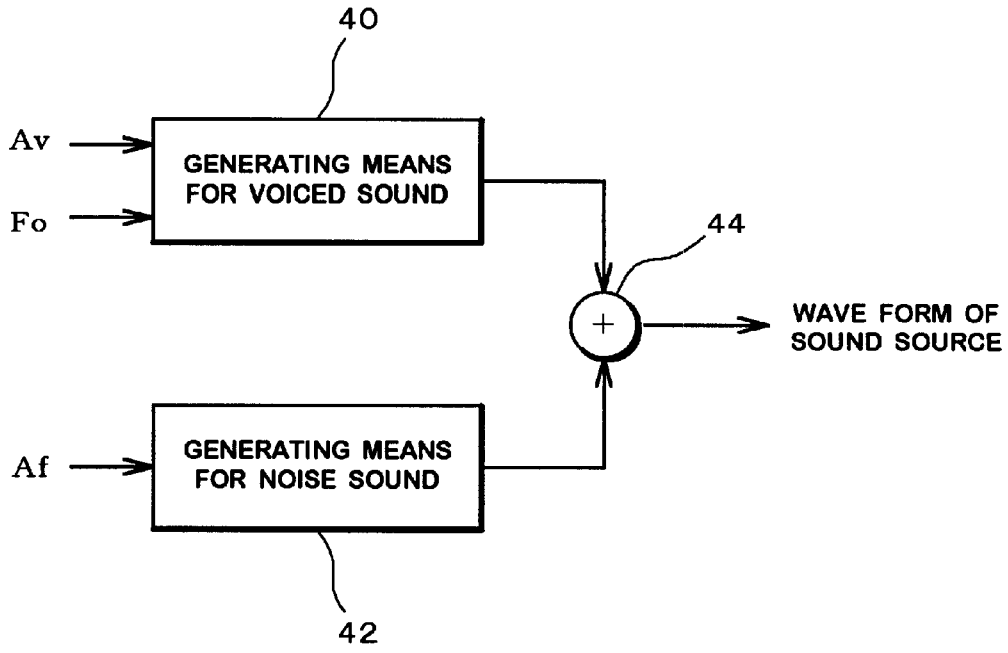
FIG. 8 describes the function of sound source generation component according to an embodiment of the present invention.
Figure 9:
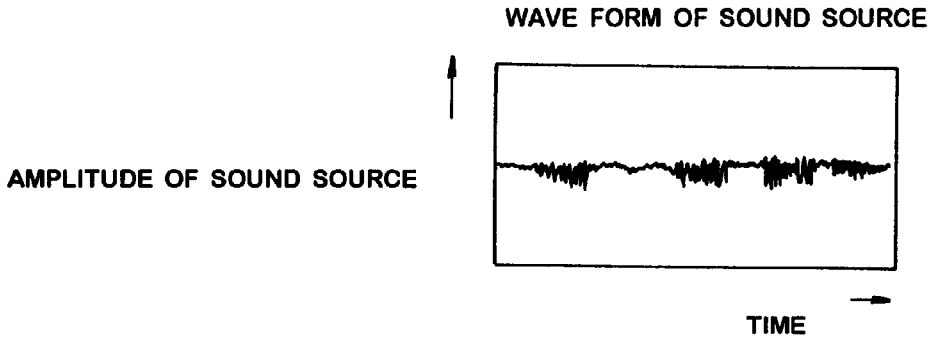
FIG. 9 shows sound source generated for an embodiment of the present invention.

Next, sound source waveforms are generated according to the fundamental frequency Fo, voiced sound source amplitude Av, and unvoiced sound source amplitude Af, as calculated above (step S8). This sound source generation process is shown in the schematic diagram in FIG. 8. The time curves of fundamental frequency Fo and the calculated time curves of voiced sound source amplitude Av are input into the voiced sound source generating component 40. Upon receiving these two, the voiced sound source generating component 40 generates a vocal folds sound source with voiced sound source amplitude Av, possessing the fundamental frequency Fo over time. The time curves of unvoiced sound source amplitude Af are input into the noise sound source generating component 42. Upon receiving this input, the noise sound source generating component 42 generates a white noise having unvoiced sound source amplitude Af over time. Next, a summation component 44 composites the pulse waveform and the white noise synchronously. Thus, the sound source waveform is obtained.

Figure 10:
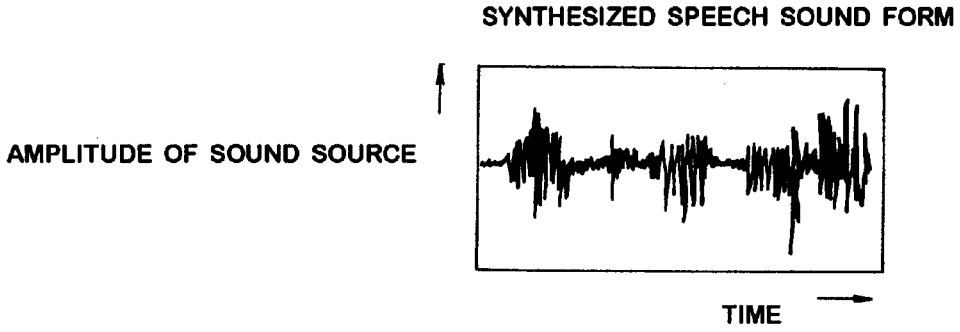
FIG. 10 shows sound source after articulation for an embodiment of the present invention.

Next, the articulation with consideration of the vocal tract transmission characteristic is applied to this sound source waveform (step S9) since this sound source waveform corresponds to the sound source waveform generated by the vocal folds and other vocal organs. The time curves of vocal tract transmission characteristic for each syllable are stored in the phoneme dictionary 14, as shown in FIG. 4F. The CPU 18 obtains the time curves of vocal tract transmission characteristic from the phoneme dictionary, associating with the phoneme symbol string (pronunciations or phonemes) from the morphological analysis in step S2. Then, the CPU performs the articulation by filtering the sound source waveforms of step S8, according to the vocal tract transmission characteristic. In this articulation, the time period of the sound source waveforms and the vocal tract transmission characteristic must be synchronized. FIG. 10 shows the articulated synthesized speech sound waveform.

Furthermore, this synthesized speech sound waveform is input into a sound card 28. The sound card then converts the synthesized speech sound waveform into analog sound data and outputs speech sound through a speaker 29.

As described above, not only the accent value, but also the descent value is applied for generating the fundamental frequency in an embodiment of the present invention. Thus, this embodiment allows the fundamental frequency to be controlled more precisely. For example, other local dialects are expressible distinctively by changing the accent value and the descent value of the same word. A dictionary of accent values and descent values (e.g., a dictionary containing syllable sequence chains) in each dialect is utilized in an embodiment of the present invention. Alternatively, supplemental information data concerning the dialect may be added to a basic dictionary.

FIG. 1B shows an overall configuration of the speech synthesis device of another embodiment of the present invention. In this embodiment, a rhythm component generating component 17 is included. The rhythm component generating component 17 is for outputting the rhythm command, which indicates the tendency of the fundamental frequency. The calculating component for sound source generating parameters 8 generates the fundamental frequency, incorporating this rhythm command, as well as the accent command and the descent command.

Figure 6A:
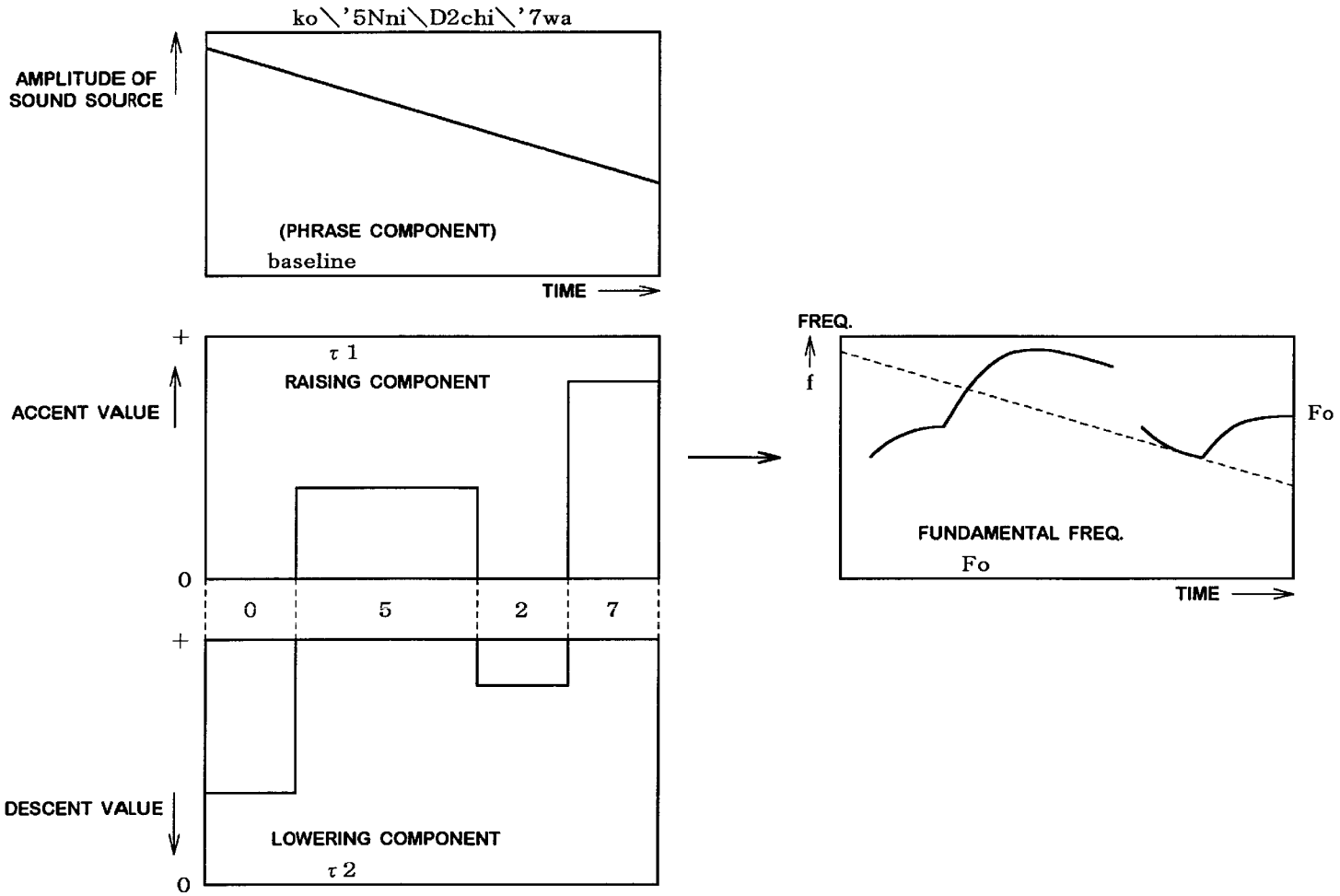
FIG. 6A and FIG. 6B show schematic diagrams of fundamental frequency generation for another embodiment of the present invention.

For example, fundamental frequency is generally descending when using the descending component indicated in FIG. 6A as the rhythm command. It is preferable to use this descending component as the rhythm command in synthesizing Tokyo dialect.

Figure 6B:
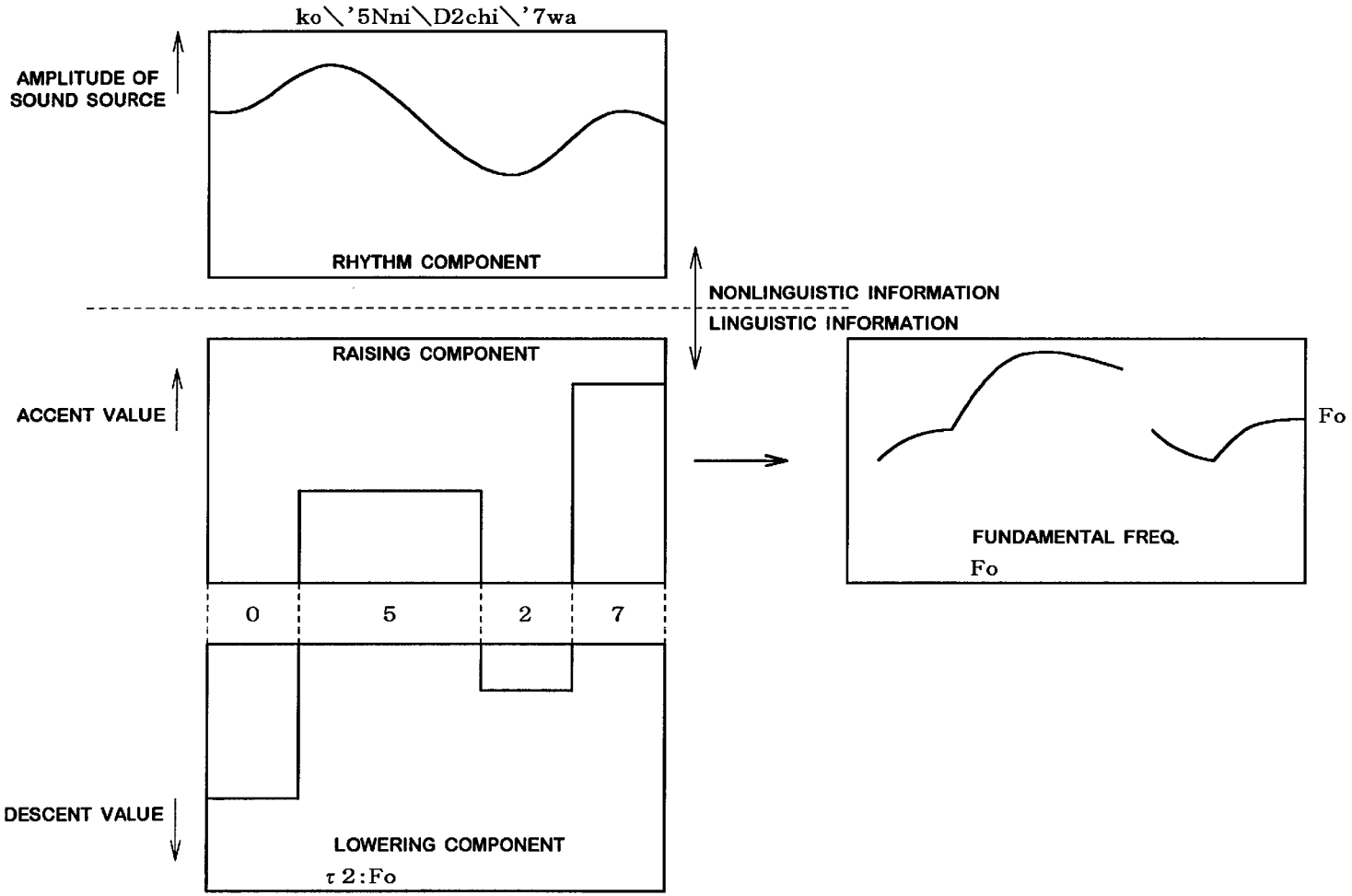

On the other hand, a sine wave, as indicated in FIG. 6B, is preferable for synthesizing Osaka dialect.

Thus, the speech synthesis device of this embodiment is applicable to various dialects and various languages by adopting the rhythm command and controlling its waveform, cycle, and amplitude.

While the embodiment described above focuses on a device for outputting speech sound corresponding to characters inputted, this invention may be applied to any type of device for generating sound source by using a fundamental frequency. For example, the invention is applicable to a device that interprets language provided, generates a character string, accent values, and descent values, and calculates fundamental frequency. Furthermore, it is applicable in an artificial electronic larynx with a structure reproduced physically from the vocal tract, in which a speaker generating a sound source is provided instead of vocal folds. In this case, the articulation of step S9 is not necessary.

In the prior art, a speech synthesis model was separately developed for each language group, such as stress typed languages like English, or languages with four tones like Chinese, in which each accent characteristic is different. In contrast, according to the present invention, these languages, each having different accent characteristics, can be synthesized with one unified model.

While, in the above embodiment, software is used to provide the respective functions shown in FIG. 1A and FIG. 1B, part or all of the functions may be provided by hardware configurations.

Embodiments of the present invention have now been described in fulfillment of the above objects. It will be appreciated that these examples are merely illustrative of the invention. Many variations and modifications will be apparent to those skilled in the art.

Glossary

The term "accent command" refers to a command for raising fundamental frequency. In FIG. 14, r1 corresponds to this command in the model. In the implementation pattern in FIG. 3, the accent value corresponds to it.

The term "descent command" refers to command for lowering fundamental frequency. In FIG. 14, r2 corresponds to this command in the model. In the implementation pattern in FIG. 3, the descent value corresponds to r2.

The term "rhythm command" refers to the command for indicating the tendency of fundamental frequency change, to which simple descent in FIG. 6A and the sine wave in FIG. 6B correspond.

The term "command concerning prosody" refers to a command for producing sound source generating parameters, to which syllable duration, accent value and descent value in the implementation pattern in FIG. 3 correspond.

The term "command concerning phoneme" refers to a command used for articulation, to which a phoneme symbol string in the implementation pattern in FIG. 1 correspond.

The term "sound source generating parameters" refers to the parameters required for generating sound source, and to which fundamental frequency and sound source amplitude in the implementation pattern in FIG. 3 correspond.

What is claimed is:

1. A sound source generation device characterized in that the device comprises:

calculating component for sound source generating parameters for outputting fundamental frequency at least as sound source generating parameters, upon receiving the command concerning prosody and according to the said command; and sound source generating component for generating sound source upon receiving sound source generating parameters from calculating component for sound source generating parameters and according to the said sound source generating parameters;

wherein the generation of fundamental frequency is represented in the model with two forces:

a force $\tau 1$ that causes the thyroid cartilage to rotate, by virtue of contraction of the cricothyroid muscle, toward the vocal folds stretch and a force $\tau 2$ that causes the cricoid cartilage to rotate toward the vocal folds contraction; and both the accent command corresponding to the said force $\tau 1$ and the descent command corresponding to the said force $\tau 2$ are given for calculating fundamental frequency; and calculating component for sound source generating parameters calculates sound source generating parameters according to the accent command and the descent command.

2. A computer-readable storing medium for storing programs, which are executable, by using a computer, for executing any device or method of claim 1 by using a computer.

3. The sound source generation device of claim 1 characterized in that:

the rhythm command indicating the tendency of fundamental frequency change is further given for calculating fundamental frequency, and calculating component for sound source generating parameters calculates sound source generating parameters according to the accent command, the descent command, and the rhythm command.

4. The sound source generation device of claim 3 characterized in that the said rhythm command is represented with a sine wave.

5. The sound source generation device of claim 4 characterized by controlling the characteristic of the generated sound source by means of controlling the amplitude and cycle of the said sine wave.

6. A speech synthesis device characterized in that the device comprises:

character string analyzing means for analyzing a given character string and generating the command concerning phoneme and the command concerning prosody, calculating means for sound source generating parameters for outputting fundamental frequency as sound source generating parameters at least, upon receiving the command concerning prosody generated by character string analyzing means and according to the said command, sound source generating means for generating sound source, upon receiving sound source generating parameters from calculating component for sound source generating parameters and according to the said sound source generating parameters, and articulation means for articulating sound source from sound source generating means according to the command concerning phoneme from character string analyzing means, wherein the generation of fundamental frequency is represented in the model with two forces: a force $\tau 1$ that causes the thyroid cartilage to rotate, by virtue of contraction of the cricothyroid muscle, toward the vocal folds stretch and a force $\tau 2$ that causes the cricoid cartilage to rotate toward the vocal folds contraction, and as well as, character string analyzing means described above generates both the accent command corresponding to the said force $\tau 1$ and the descent command corresponding to the said force $\tau 2$ for calculating the fundamental frequency, and calculating means for sound source generating parameters described above calculates fundamental frequency according to the accent command and the descent command.

7. The speech synthesis device of claim 6 is characterized in that:

character string analyzing means further generates the rhythm command indicating the tendency of fundamental frequency change as the command concerning prosody, and calculating means for sound source generating parameters calculates fundamental frequency according to the accent command, the descent command, and the rhythm command.

8. The speech synthesis device of claim 7 characterized in that calculating means for sound source generating parameters generates the rhythm command as a sine wave.

9. The speech synthesis device of claim 8 characterized in that calculating means for sound source generating parameters controls the characteristic of synthesized speech sound generated, by means of controlling the amplitude and cycle of the said sine wave.

10. A speech processing method using fundamental frequency as parameters at least characterized by:

modeling the generation of fundamental frequency with two forces: a force $\tau 1$ that causes the thyroid cartilage to rotate, by virtue of contraction of the cricothyroid muscle, toward the vocal folds stretch and a force $\tau 2$ that causes the cricoid cartilage to rotate toward the vocal folds contraction, and as well as, adopting the accent command corresponding to the said force $\tau 1$ and the descent command corresponding to the said force $\tau 2$ for calculating fundamental frequency as elements for controlling the said fundamental frequency.

11. The speech processing method of claim 10 characterized by further adopting the rhythm command indicating the tendency of fundamental frequency change as elements for controlling fundamental frequency.

12. A speech analyzing method for analyzing the characteristic of speech sound characterized by:

modeling the generation of fundamental frequency with two forces: a force $\tau 1$ that causes the thyroid cartilage to rotate, by virtue of contraction of the cricothyroid muscle, toward the vocal folds stretch and a force $\tau 2$ that causes the cricoid cartilage to rotate toward the vocal folds contraction, and as well as, by performing analysis using the accent command corresponding to the said force $\tau 1$ and the descent command corresponding to the said force $\tau 2$ as elements for analyzing fundamental frequency of the speech sound.

13. The speech analyzing method of claim 12 characterized by further adopting the rhythm command indicating the tendency of fundamental frequency change as elements for analyzing the said fundamental frequency.

* * * * *